US011670228B2

(12) United States Patent
Lee et al.

(10) Patent No.: US 11,670,228 B2
(45) Date of Patent: Jun. 6, 2023

(54) DISPLAY DEVICE AND METHOD OF DRIVING THE SAME

(71) Applicant: Samsung Display Co., Ltd., Yongin-si (KR)

(72) Inventors: Jae Hoon Lee, Yongin-si (KR); Jung Taek Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/952,314

(22) Filed: Sep. 26, 2022

(65) Prior Publication Data

US 2023/0133826 A1 May 4, 2023

(30) Foreign Application Priority Data

Nov. 3, 2021 (KR) ..... 10-2021-0150083

(51) Int. Cl.
*G09G 3/32* (2016.01)

(52) U.S. Cl.
CPC ..... *G09G 3/32* (2013.01); *G09G 2300/0842* (2013.01); *G09G 2310/0278* (2013.01); *G09G 2310/08* (2013.01); *G09G 2320/0271* (2013.01)

(58) Field of Classification Search
CPC ..... G09G 3/32; G09G 2300/0842; G09G 2310/0278; G09G 2310/08; G09G 2320/0271
See application file for complete search history.

(56) References Cited

U.S. PATENT DOCUMENTS

| | | | | |
|---|---|---|---|---|
| 10,380,942 | B2 | 8/2019 | An et al. | |
| 10,825,395 | B2 | 11/2020 | Chen et al. | |
| 2009/0303172 | A1 | 12/2009 | Park et al. | |
| 2019/0035875 | A1* | 1/2019 | Xin | H01L 27/124 |
| 2019/0036049 | A1* | 1/2019 | Kim | G06F 1/1652 |

FOREIGN PATENT DOCUMENTS

| | | |
|---|---|---|
| KR | 10-2009-0128255 | 12/2009 |
| KR | 10-2018-0067152 | 6/2018 |

* cited by examiner

*Primary Examiner* — Sejoon Ahn

(74) *Attorney, Agent, or Firm* — H.C. Park & Associates, PLC

(57) ABSTRACT

A display device includes: a display unit including a scan line, a data line, and a pixel connected to the scan line and the data line; a scan driver for supplying a scan signal to the scan line; a data driver for supplying a data signal to the data line in a display mode, supplying a first voltage and a second voltage to the data line respectively during a first period and a second period in a sensing mode, and outputting a first sensing signal and a second sensing signal by sensing a driving current of the pixel during the first period and the second period; and a timing controller for converting first image data into second image data, based on the first sensing signal and the second sensing signal.

20 Claims, 11 Drawing Sheets

300: 310, 320
Camp: Camp1, Camp2
SWs: SWs1, SWs2
Von: Von1, Von2

DISPLAY DEVICE AND METHOD OF DRIVING THE SAME

CROSS REFERENCE TO RELATED APPLICATION

This application claims priority from and the benefit of Korean patent application 10-2021-0150083 filed on Nov. 3, 2021, which is hereby incorporated by reference for all purposes as if fully set forth herein.

BACKGROUND

Field

Embodiments of the invention relate generally to a display device and a method of driving the display device and more specifically, to a display device and a method of driving the display device in a display mode and a sensing mode.

Discussion of the Background

A display device includes pixels, and displays an image by driving the pixels with a luminance corresponding to input image data. Each of the pixels may include a light emitting element and a driving transistor for supplying a driving current to the light emitting element such that the light emitting element emits light with a luminance corresponding to the driving current.

An electrical characteristic of each pixel, which includes a threshold voltage of the driving transistor, and the like, is a factor which determines the driving current, and the electrical characteristic of the pixels may be changed by various causes such as a process variation and aging. The display device may sense an electrical characteristic of the pixels, and compensate for a change in the electrical characteristic of the pixels.

The above information disclosed in this Background section is only for understanding of the background of the inventive concepts, and, therefore, it may contain information that does not constitute prior art.

SUMMARY

Display devices and methods of driving the display devices according to the principles of the invention are capable of displaying high quality image and improving reliability by more accurately and efficiently sensing electrical characteristics of pixels and by modifying image data based on the sensed electrical characteristics of pixels.

Additional features of the inventive concepts will be set forth in the description which follows, and in part will be apparent from the description, or may be learned by practice of the inventive concepts.

According to an aspect of the invention, a display device including: a display unit including a scan line, a data line, and a pixel connected to the scan line and the data line; a scan driver to supply a scan signal to the scan line; a data driver to supply a data signal to the data line in a display mode, supply a first voltage and a second voltage to the data line respectively during a first period and a second period in a sensing mode, and output a first sensing signal and a second sensing signal by sensing a driving current of the pixel during the first period and the second period; and a timing controller to convert first image data into second image data, based on the first sensing signal and the second sensing signal, wherein the data driver includes an integrator outputting a first analog sensing signal and a second analog sensing signal by sensing a driving current of the pixel during the first period and the second period, the integrator including a variable capacitor, and wherein, during the first period and the second period, a capacitance of the variable capacitor is adjusted to different values according to the first voltage and the second voltage.

The first voltage may be a sensing grayscale voltage corresponding to a first grayscale value, and the second voltage may be a sensing grayscale voltage corresponding to a second grayscale value greater than the first grayscale value.

The capacitance of the variable capacitor may be adjusted to a first value during the first period. The capacitance of the variable capacitor may be adjusted to a second value greater than the first value during the second period.

The first grayscale value may be a grayscale value in a first grayscale range, which corresponds a driving current smaller than a reference current, and the second grayscale value may be a grayscale value in a second grayscale range, which corresponds to a driving current equal to or greater than the reference current.

In the sensing mode, the data driver may be to supply a third voltage to the data line during a third period, and output a third sensing signal by sensing a driving current of the pixel during the third period. The timing controller may be to convert the first image data into the second image data, based on the first sensing signal, the second sensing signal, and the third sensing signal.

The third voltage may be a sensing grayscale voltage which is included in the first grayscale range and is different from the first grayscale value.

The data driver may further include a converter connected to an output terminal of the integrator, the converter to convert the first analog sensing signal and the second analog sensing signal respectively into the first sensing signal and the second sensing signal.

During the first period and the second period, the capacitance of the variable capacitor may be adjusted according to the first voltage, the second voltage, and a resolution of the converter.

In the display mode, the timing controller may be to output the second image data to the data driver, and the data driver may be to generate the data signal, based on the second image data.

According to another aspect of the invention, a method of driving a display device includes: setting a sensing grayscale voltage as a first voltage; adjusting a variable capacity of an integrator included in a sensing circuit to a first value; supplying the first voltage to a pixel, and sensing a driving current of the pixel; generating a first compensation value of the first voltage; setting the sensing grayscale voltage as a second voltage; adjusting the variable capacity of the integrator to a second value; supplying the second voltage to the pixel, and sensing a driving current of the pixel; generating a second compensation value of the second voltage; converting first image data into second image data, based on the first compensation value and the second compensation value; generating a data signal, based on the second image data; and driving the pixel with the data signal.

The first voltage may be a voltage corresponding to a first grayscale value, and the second voltage may be a voltage corresponding to a second grayscale value greater than the first grayscale value.

The variable capacity of the integrator, which is adjusted to the second value, may be greater than the variable capacity of the integrator, which is adjusted to the first value.

The first grayscale value may be a grayscale value in a first grayscale range, which corresponds to a driving current smaller than a reference current, and the second grayscale value may be a grayscale value in a second grayscale range, which corresponds to a driving current equal to or greater than the reference current.

The method may further include: setting the sensing grayscale voltage as a third voltage; adjusting the variable capacity of the integrator to a third value; supplying the third voltage to the pixel, and sensing a driving current of the pixel; and generating a third compensation value of the third voltage. The first image data may be converted into the second image data, based on the first compensation value, the second compensation value, and the third compensation value.

The third voltage may be a voltage corresponding to a driving current smaller than the reference current, and be different from the first voltage.

According to another aspect of the invention, a display device includes: a display unit including a scan line, a data line, a sensing line, and a pixel connected to the scan line, the data line, and the sensing line; a scan driver to supply a scan signal to the scan line; a data driver to supply a data signal to the data line in a display mode, supply a first voltage and a second voltage to the data line respectively during a first period and a second period in a sensing mode, and output a first sensing signal and a second sensing signal to the sensing line by sensing a driving current of the pixel during the first period and the second period; and a timing controller to convert first image data into second image data, based on the first sensing signal and the second sensing signal, wherein the data driver includes a current-to-voltage converter to convert the driving current of the pixel into a sensing voltage at different current-to-voltage conversion ratios according to the first voltage and the second voltage.

The first voltage may be a sensing grayscale voltage corresponding to a first grayscale value, and the second voltage may be a sensing grayscale voltage corresponding to a second grayscale value greater than the first grayscale value.

The current-to-voltage converter may be to convert the driving current of the pixel to a first sensing current at a first current-to-voltage conversion ratio during the first period, and to convert the driving current of the pixel to a second sensing current at a second current-to-voltage conversion ratio during the second period, the first current-to-voltage conversion ratio being greater than the second current-to-voltage conversion ratio.

The first grayscale value may be a grayscale value in a first grayscale range, which corresponds a driving current smaller than a reference current, and the second grayscale value may be a grayscale value in a second grayscale range, which corresponds to a driving current equal to or greater than the reference current.

The the current-to-voltage converter may include a variable capacitor, and wherein during the first period and the second period, a capacitance of the variable capacitor may be adjusted to different values according to the first voltage and the second voltage.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
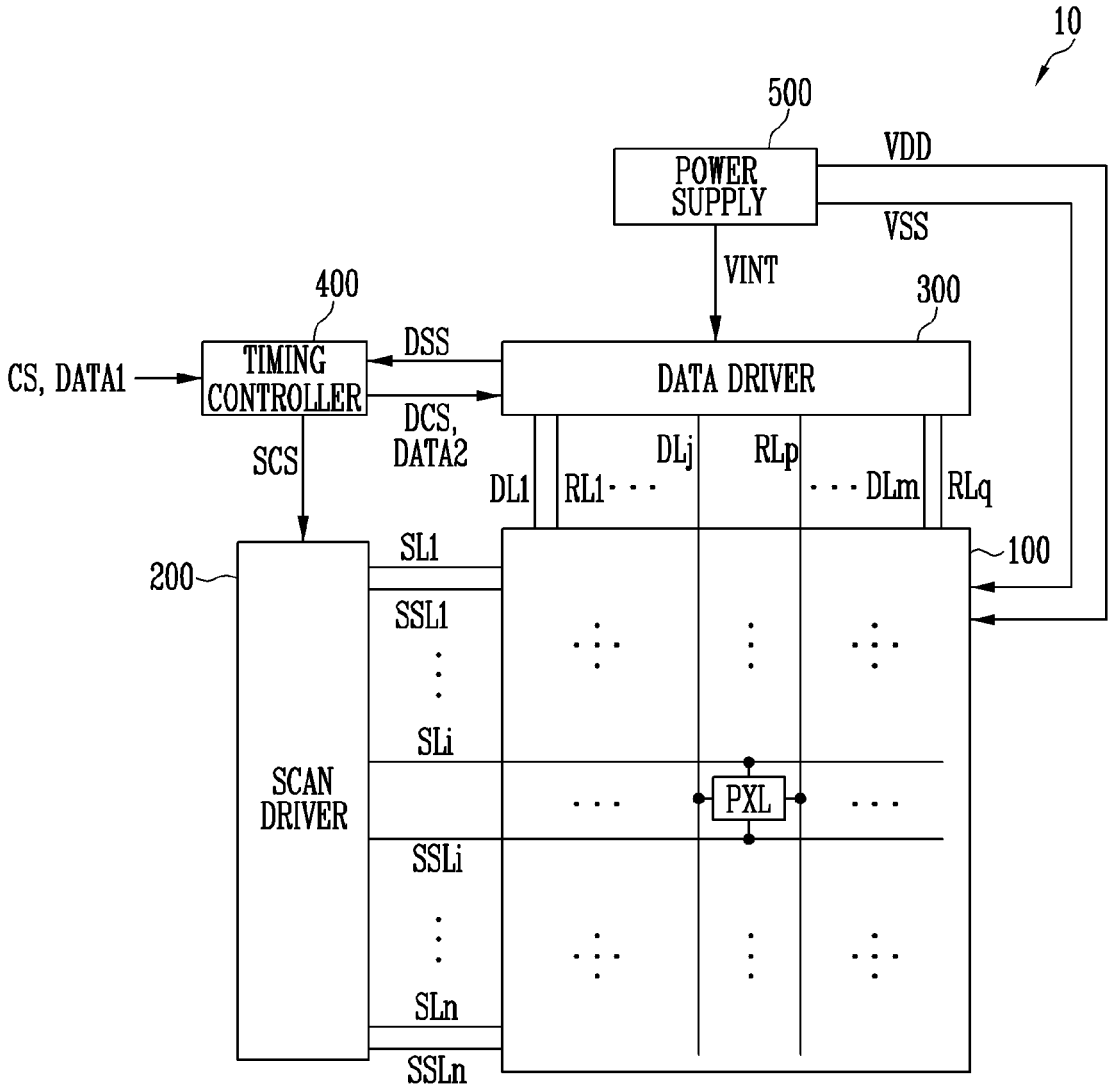
FIG. 1 is a diagram illustrating an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a diagram illustrating a display device 10 in accordance with an embodiment.

Referring to FIG. 1, the display device 10 may include a display unit 100 (e.g., display panel), a scan driver 200 (e.g., gate driver), a data driver 300 (e.g., source driver), a timing controller 400, and a power supply (e.g., power voltage generator). The scan driver 200, the data driver 300, the timing controller 400, and the power supply 500 may constitute a driving device which drives the display unit 100.

The display device 10 may be driven in different manners according to a display mode and a sensing mode. For example, in the display mode, pixels PXL may be driven based on first image data DATA1 (e.g., input image data), and accordingly, an image corresponding to the first image data DATA1 may be displayed on the display unit 100. In the sensing mode, a driving current flowing in the pixels PXL may be sensed by using the data driver 300 (or by using a sensing unit configured separately from the data driver 300). Further, based on the driving current sensed in the sensing mode, a change in electrical characteristic of the pixels PXL and/or a deviation between electrical characteristics of the pixels PXL may be compensated.

In order to sense an electrical characteristic (e.g., a driving current) of the pixels PXL, the display device 10 may include a sensing circuit (or a sensing unit). The sensing circuit may be included in the data driver 300, but embodiments are not limited thereto. For example, the display device 10 may include a sensing circuit, which is configured and/or provided separately from the data driver 300.

The display unit 100 may display an image. The display device 10 may include scan lines SL1 to SLn, data lines DL1 to DLm, and pixels PXL connected to the scan lines SL1 to SLn and the data lines DL1 to DLm, where each of n and m is a positive integer. The display unit 100 may further include sensing scan lines SSL1 to SSLn and readout lines RL1 to RLq (e.g., sensing lines), where q is a positive integer equal to or smaller than m. The readout lines RL1 to RLq may be provided and/or formed separately from the data lines DL1 to DLm, but embodiments are not limited thereto. For example, the readout lines RL1 to RLq may be integrated with the data lines DL1 to DLm, and sense an electrical characteristic of the pixels PXL by connecting the data lines DL1 to DLm to the sensing circuit during a sensing period.

The pixels PXL may be disposed in areas (e.g., pixel areas) defined by the scan lines SL1 to SLn and the data lines DL1 to DLm, and be respectively connected to the scan lines SL1 to SLn and the data lines DL1 to DLm. For example, a pixel PXL disposed in an i-th row and a j-th column of the display unit 100 may be connected to an i-th scan line SLi (e.g., i-th first scan line) and a j-th data line DLj, where each of i and j is a positive integer.

The pixels PXL may be further connected to the sensing scan lines SSL1 to SSLn and/or the readout lines RL1 to RLq. For example, the pixel PXL disposed in the i-th row and the j-th column of the display unit 100 may be further connected to an i-th sensing scan line SSLi (e.g., i-th second scan line) and a p-th readout line RLp, where p is a positive integer equal to or smaller than q.

The configuration (e.g., kind and/or number) of signal lines connected to the pixels PXL may be changed according to a circuit structure, a driving method, and the like of the pixels PXL. For example, at least one control line may be additionally formed in the display unit 100 according to the circuit structure of the pixels PXL, and the pixels PXL may be further connected to the at least one control line.

The pixels PXL may be electrically connected between a first power line (e.g., a first power line PL1 in FIG. 2) to which a first power voltage VDD is applied and a second power line (e.g., a second power line PL2 in FIG. 2) to which a second power voltage VSS is applied. The first and second power voltages VDD and VSS may be power voltages or driving voltages, which are used for an operation of the pixels PXL, and have different voltage levels. For example, the first power voltage VDD may have a voltage level higher than a voltage level of the second power voltage VSS. The first and second power voltages VDD and VSS may be provided from the power supply 500 to the display unit 100.

Hereinafter, based on the pixel disposed in the i-th row and the j-th column, the configuration and the driving method for the pixel PXL and the display device 10 including the pixel PXL according to an embodiment will be described. The pixels PXL provided in the display unit 100 may have structures substantially identical or similar to each other, and be driven in manners substantially identical or similar to each other.

The pixel PXL disposed in the i-th row and the j-th column may be connected to the i-th scan line SLi, the i-th sensing scan line SSLi, the j-th data line DLj, and/or the p-th readout line RLp. The pixel PXL may be initialized by using a third power voltage VINT (e.g., an initialization voltage or reference voltage) provided through the p-th readout line RLp in response to an i-th sensing scan signal provided through the i-th sensing scan line SSLi, and store or record a data signal (e.g., data voltage) provided through the j-th data line DLj in response to an i-th scan signal provided through the i-th scan line SLi. The pixel PXL may emit light having a luminance corresponding to the stored data signal.

A voltage level of the third power voltage VINT may be set lower than an operating point (e.g., threshold voltage) of a light emitting element provided in the pixel PXL. The third power voltage VINT may be provided from the power supply 500 to the display unit 100 through the data driver 300 (e.g., a separate sensing circuit).

The scan driver 200 may generate scan signals, based on a scan control signal SCS, and supply the scan signals to the respective scan lines SL1 to SLn. For example, the scan driver 200 may sequentially supply scan signals (e.g., first scan signals) to the scan lines SL1 to SLn, based on the scan control signal SCS. The scan control signal SCS may include a start signal and clock signals, and be provided from the timing controller 400 to the scan driver 200. For example, the scan driver 200 may include a shift register which generates and outputs scan signals by sequentially shifting the start signal in a pulse form by using the clock signals. Also, similarly to the manner that generates the scan signals, the scan driver 200 may generate sensing scan signals, and supply the sensing scan signals to the respective sensing scan lines SSL1 to SSLn. For example, the scan driver 200 may sequentially supply sensing scan signals (e.g., second scan signals) to the sensing scan lines SSL1 to SSLn, based on the scan control signal SCS.

In an example, the scan driver 200 may be formed together with the pixels PXL on the display unit 100, and be electrically connected to the timing controller 400 through a circuit film or the like. In another example, the scan driver 200 may be mounted on a circuit film (e.g., circuit substrate), and be electrically connected to the display unit 100 and the timing controller 400.

The data driver 300 may generate data signals (e.g., data voltages), based on second image data DATA2 (e.g., compensated image data) and a data control signal DCS, which are provided from the timing controller 400, and provide the data signals to the respective pixels PXL through the data lines DL1 to DLm. The data control signal DCS is a signal for controlling an operation of the data driver 300, and may include a load signal (e.g., data enable signal) for controlling output of a valid data signal, a horizontal start signal, a data clock signal, and the like. For example, the data driver 300 may include a shift register which generates a sampling signal by shifting the horizontal start signal in synchronization with the data clock signal, a latch which latches the second image data DATA2 in response to the sampling signal, a digital-analog converter (e.g., decoder) which converts the latched image data (e.g., data in a digital form) into data signals in an analog form, and buffers (e.g., amplifiers) which output the data signals to the data lines DL1 to DLm.

The data driver 300 may receive the third power voltage VINT provided from the power supply 500. The data driver 300 may provide the third power voltage VINT to the pixels PXL through the readout lines RL1 to RLq.

In embodiments, the data control signal DCS may further include sensing control signals for controlling an operation of the data driver 300 in a sensing period (e.g., a sensing period for sensing an electrical characteristic of the pixels PXL, such as a threshold voltage and/or a mobility of driving transistors included in the pixels PXL) in which the sensing mode is executed. The data driver 300 may provide a sensing grayscale voltage (e.g., test voltage) corresponding to at least one reference grayscale value to pixels of at least one horizontal line through the data lines DL1 to DLm during each sensing period, based on the sensing control signals, and sense a driving current flowing in the pixels PXL of the at least one horizontal line through the readout lines RL1 to RLq.

In an embodiment, when the data driver 300 senses an electrical characteristic of the pixels PXL, the data driver 300 may output a sensing grayscale voltage corresponding to one reference grayscale value to the data lines DL1 to DLm for every sensing period of one cycle (e.g., a sub-sensing period obtained by dividing the sensing period). Also, when the data driver 300 senses an electrical characteristic of the pixels PXL, the data driver 300 may supply sensing grayscale voltages corresponding to at least two sensing grayscale values (e.g., reference grayscale values or observation grayscale values) in different sensing periods (e.g., sub-sensing periods), and individually and/or independently sense a driving current flowing in the pixels PXL, corresponding to each of the sensing grayscale voltages. Accordingly, the data driver 300 can more precisely and/or more accurately sense the electrical characteristic of the pixels PXL.

The data driver 300 may convert analog sensing signals corresponding to the driving current sensed from the pixels PXL, which is generated based on each of the sensing grayscale voltages, into digital sensing signals DSS. The data driver 300 may provide the digital sensing signals DSS to the timing controller 400.

In an embodiment, the data driver 300 may be mounted on a circuit film, and be electrically connected to the display unit 100 and the timing controller 400.

The timing controller 400 may receive first image data DATA1 and control signals CS from the outside (e.g., a graphic processor). The timing controller 400 may generate scan control signals SCS and data control signals DCS, based on the control signals CS, and generate second image data DATA2 by converting the first image data DATA1. The control signals may include timing control signals such as a vertical synchronization signal, a horizontal synchronization signal, and a reference clock signal. The vertical synchronization signal may represent a start of frame data (e.g., data corresponding to a frame period in which one frame image is displayed), and the horizontal synchronization signal may represent a start of a data row (e.g., one data row among a plurality of data rows included in the frame data). For example, the timing controller 400 may convert the first image data DATA1 into the second image data DATA2 having a format, which is compatible with a pixel arrangement in the display unit 100.

In embodiments, the timing controller 400 may receive digital sensing signals DSS from the data driver 300 (e.g., the separate sensing circuit), and compensate for an electrical characteristic of the pixels PXL (e.g., a change in electrical characteristic of the pixels PXL and/or a deviation between electrical characteristics of the pixels PXL), based on the digital sensing signals DSS. For example, the timing controller 400 may generate compensation values for compensating for the electrical characteristic of the pixels PXL, based on the digital sensing signals DSS. In an example, the timing controller 400 may generate compensation values of each of the sensing grayscale voltages such that the change in electrical characteristic of the pixels PXL and the deviation between electrical characteristics of the pixels PXL can be compensated based on the digital sensing signals DSS, which are obtained according to a change in threshold voltage of the driving transistors included in the pixels PXL, a change in mobility of the driving transistors, and/or a change in characteristic of light emitting elements. In an embodiment, the timing controller 400 may generate each compensation value by using a relational expression (e.g., a relational expression derived by modeling a degradation characteristic of the pixels) and/or an interpolation method with respect to the other grayscale voltages except the sensing grayscale voltages.

Corresponding to the display mode, the timing controller 400 may convert the first image data DATA1 into the second image data DATA2, based on the compensation values generated according to the electrical characteristic of the pixels PXL, which is sensed in the sensing mode. The second image data DATA2 may be supplied to the data driver 300, and the data driver 300 may generate data signals corresponding to the second image data DATA2. The data signals may be supplied to the pixels PXL through the data lines DL1 to DLm. Accordingly, the pixels PXL are driven by the data signals obtained according to the respective compensation values, so that the electrical characteristic of the pixels PXL can be compensated.

The power supply 500 may be electrically connected to the display unit 100 and the data driver 300. The power supply 500 may supply the first power voltage VDD and the second power voltage VSS to the display unit 100, and provide the third power voltage VINT to the data driver 300.

In an embodiment, the power supply 500 may be further electrically connected to at least one of the scan driver 200, the data driver 300, and the timing controller 400. The power supply 500 may provide a power voltage for driving at least one of the scan driver 200, the data driver 300, and the timing controller 400.

In an embodiment, the power supply 500 may be a power management IC (PMIC) or include the PMIC.

At least one of the scan driver 200, the data driver 300, the timing controller 400, and the power supply 500 may be formed in the display unit 100, or be implemented as an integrated circuit to be connected to the display unit 100 in the form of a tape carrier package or the like. In an embodiment, at least two of the scan driver 200, the data driver 300, the timing controller 400, and the power supply 500 may be formed as one integrated circuit.

Figure 2:
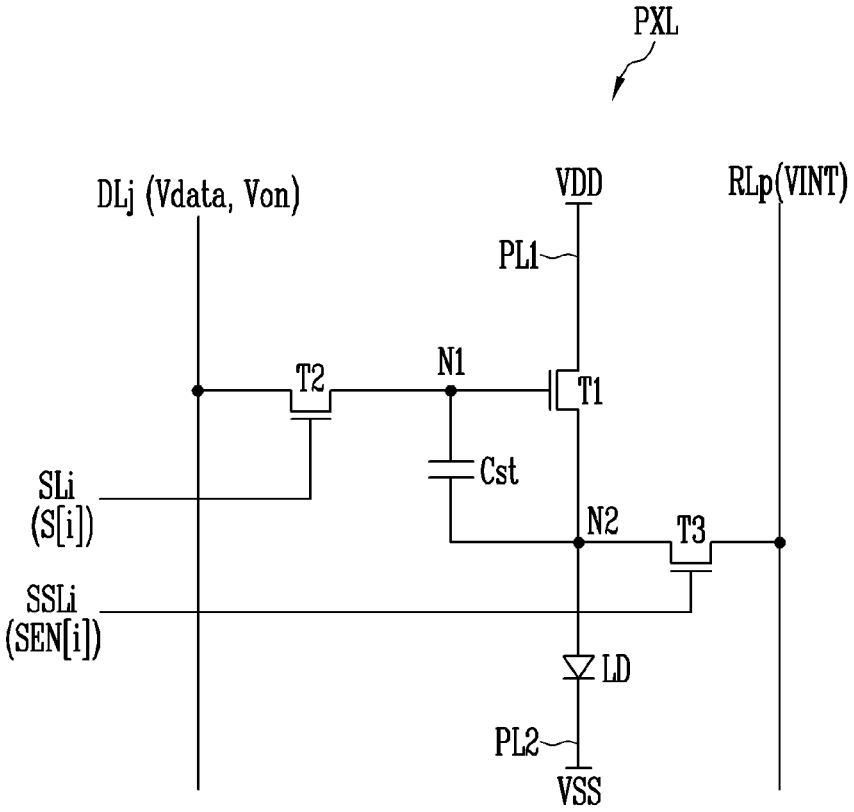
FIG. 2 is a diagram illustrating a representative pixel in FIG. 1.

FIG. 2 is a diagram illustrating the pixel PXL in FIG. 1. In FIG. 2, a pixel PXL disposed in an i-th row and a j-th column is exemplarily illustrated.

Referring to FIG. 2, the pixel PXL may be connected to an i-th scan line SLi, a j-th data line DLj, a first sensing scan line SSLi, and a p-th readout line RLp.

The pixel PXL may include a light emitting element LD, a first transistor T1 (e.g., driving transistor), a second transistor T2 (e.g., first switching transistor), a third transistor T3 (e.g., second switching transistor), and a storage capacitor Cst. In an embodiment, at least one of the first transistor T1, the second transistor T2, and the third transistor T3 may be a thin film transistor including an oxide transistor. For example, the first transistor T1 may include an oxide semiconductor. However, embodiments are not limited thereto. For example, at least one of the first transistor T1, the second transistor T2, and the third transistor T3 may include an amorphous silicon semiconductor or a polycrystalline silicon semiconductor.

In an embodiment, at least one of the first transistor T1, the second transistor T2, and the third transistor T3 may be an N-type transistor. For example, the first transistor t1 may be an N-type transistor. However, embodiments are not limited thereto. For example, at least one of the first transistor T1, the second transistor T2, and the third transistor T3 may be a P-type transistor.

The light emitting element LD may be connected (e.g., electrically connected) between the first power line PL1 and the second power line PL2. For example, a first electrode (e.g., anode electrode) of the light emitting element LD may be connected to the first power line PL1 via a second node N2 and the first transistor T1, and a second electrode (e.g., cathode electrode) of the light emitting element LD may be connected to the second power line PL2. The first power voltage VDD may be applied to the first power line PL1. The second power voltage VSS may be applied to the second power line PL2.

The light emitting element LD may emit light with a luminance corresponding to a driving current supplied from the first transistor T1 (e.g., the amount of the driving current). The light emitting element LD may be configured as an organic light emitting diode or an inorganic light emitting diode such as a micro LED (light emitting diode) or a quantum dot light emitting diode. The kind, structure, size, and/or number of the light emitting element LD provided in each pixel PXL may be changed in some embodiments.

The first transistor T1 may be connected between the first power line PL1 and the second node N2. For example, a first electrode (e.g., a drain electrode) of the first transistor T1 may be connected to the first power line PL1, and a second electrode (e.g., a source electrode) of the first transistor T1 may be connected to the second node N2 (e.g., the anode electrode of the light emitting element LD). The second node N2 may be a node, at which the first transistor T1 and the light emitting element LD are connected to each other. A gate electrode of the first transistor T1 may be connected to a first node N1. The first transistor T1 may control a driving current flowing through the light emitting element LD, corresponding to a voltage of the first node N1 (e.g., a gate-source voltage applied between the second electrode and the gate electrode of the first transistor T1).

The second transistor T2 may be connected to the j-th data line DLj and the first node N1. A gate electrode of the second transistor T2 may be connected to an i-th scan line SLi. When an i-th scan signal S[i] (e.g., a scan signal having a gate-on voltage) is supplied to the i-th scan line SLi, the second transistor T2 may be turned on in response to the i-th scan signal S[i]. When the second transistor T2 is turned on, a data signal Vdata (e.g., sensing grayscale voltage Von) from the j-th data line DLj may be transferred to the first node N1.

The storage capacitor Cst may be connected between the first node N1 and the second node N2. Charges corresponding to the voltage of the first node N1 may be charged in the storage capacitor Cst.

The third transistor T3 may be connected between the second node N2 (e.g., the second electrode of the first transistor T1) and the p-th readout line RLp. A gate electrode of the third transistor T3 may be connected to the i-th sensing scan line SSLi. When an i-th sensing scan signal SEN[i] (e.g., a sensing scan signal having the gate-on voltage) is supplied to the i-th sensing scan line SSLi, the third transistor T3 may be turned on in response to the i-th sensing scan signal SEN[i]. When the third transistor T3 is turned on, the second node N2 and the p-th readout line RLp may be connected to each other. The third power voltage VINT applied to the p-th readout line RLp may be applied to the second node N2. A voltage of the second node N2 (e.g., a voltage of the first electrode of the light emitting element LD) may be initialized by the third power voltage VINT.

When the second transistor T2 and the third transistor T3 are simultaneously turned on in response to the i-th scan signal S[i] and the first sensing scan signal SEN[i], a voltage corresponding to a voltage difference between the data signal Vdata (e.g., the sensing grayscale voltage Von) and the third power voltage VINT may be stored in the storage capacitor Cst, and the first transistor T1 may control the driving current flowing through the light emitting element LD, corresponding to the voltage difference stored in the storage capacitor Cst (e.g., the gate-source voltage of the first transistor T1).

When a state, in which the third transistor T3 is turned on, is maintained by the i-th sensing scan signal SEN[i] during a sensing period, a driving current corresponding to the voltage difference (e.g., a voltage difference between the sensing grayscale voltage Von and the third power voltage VINT) may be input to the data driver 300 (e.g., the sensing circuit provided to the data driver 300) from the pixel PXL through the p-th readout line RLp. For example, during a sensing period in which the sensing mode is executed, when the first transistor T1 is turned on by the sensing grayscale voltage Von (e.g., at least one sensing grayscale voltage Von corresponding to at least one reference grayscale value), the driving current of the pixel PXL, which flows through the first transistor T1, corresponding to the sensing grayscale voltage Von, may be output as a sensing signal through the p-th readout line RLp.

The structure of the pixel PXL is not limited to the embodiment shown in FIG. 2. For example, the structure of the pixel PXL and the driving method according thereto may be variously changed in some embodiments.

Figure 3:
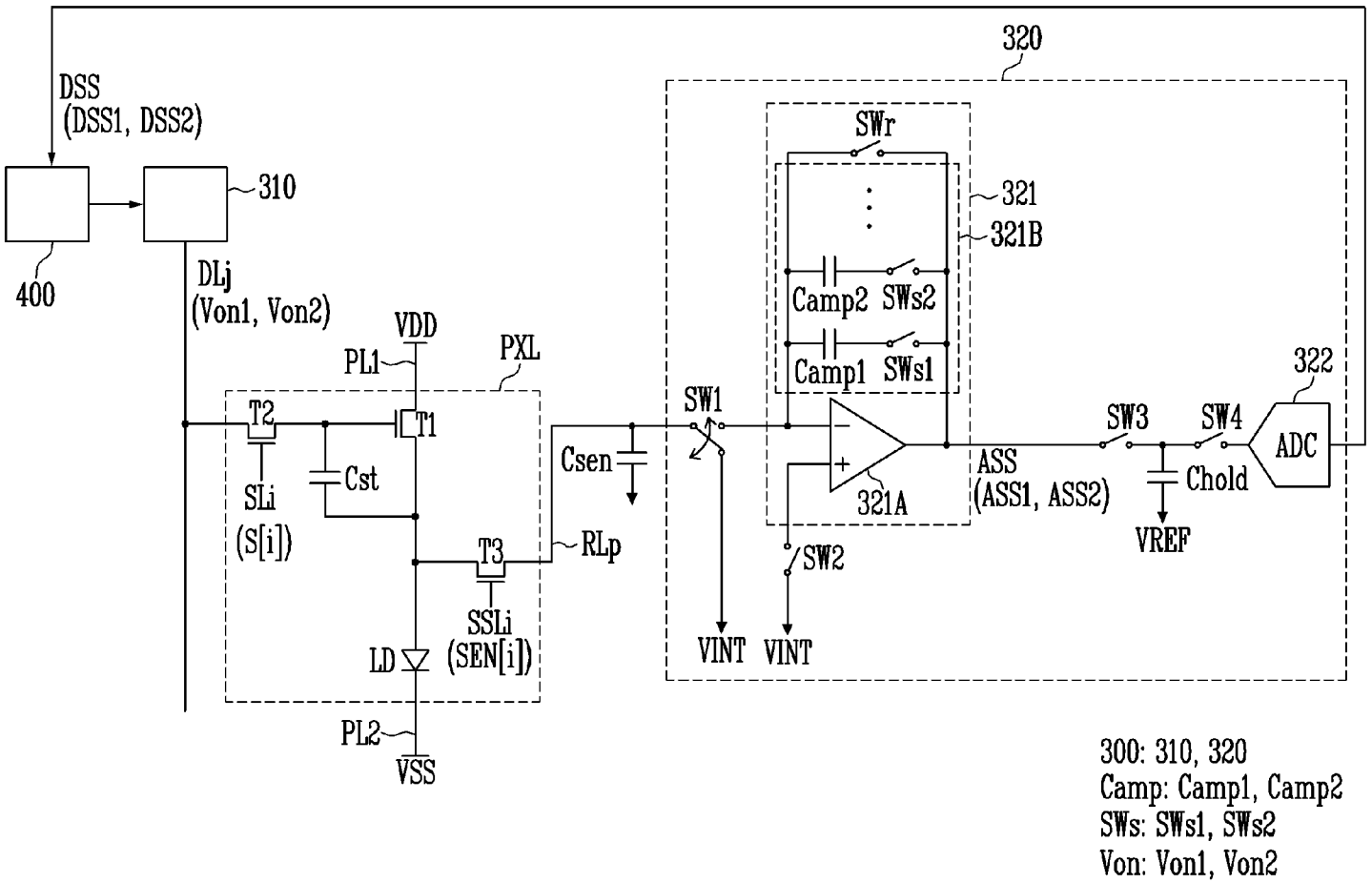
FIG. 3 is a diagram illustrating an embodiment of a data driver in FIG. 1.

FIG. 3 is a diagram illustrating an embodiment of the data driver 300 shown in FIG. 1. A pixel PXL connected to the data driver 300 (e.g., a pixel PXL disposed in an i-th row and a j-th column) and the timing controller 400 are further illustrated in FIG. 3. Additionally, output signals of the data driver 300 in the sensing mode are further illustrated in FIG. 3.

Referring to FIGS. 1, 2, and 3, the data driver 300 may include a data signal generation circuit 310 (e.g., data signal generator) and a sensing circuit 320 (e.g., sensing unit). The data driver 300 may be driven in the display mode or the sensing mode according to the data control signal DCS supplied from the timing controller 400.

In the display mode, the data driver 300 may supply data signals Vdata to the respective data lines DL1 to DLm. Accordingly, the pixels PXL may emit lights with luminances corresponding to the respective data signals Vdata.

In the sensing mode, the data driver 300 may sequentially, alternately, and/or repeatedly supply at least two sensing grayscale voltages Von to each of the data lines DL1 to DLm, and generate digital sensing signals DSS by sensing a driving current flowing in the pixels PXL, corresponding to each of the sensing grayscale voltages Von. The digital sensing signals DSS may be output to the timing controller 400 to be used to compensate for an electrical characteristic of the pixels PXL.

The data signal generation circuit 310 may output data signals Vdata or sensing grayscale voltages Von to the data lines DL1 to DLm, based on data control signals DCS and second image data DATA2, which are supplied from the timing controller 400. In an example, the data signal generation circuit 310 may output data signals Vdata corresponding to the second image data DATA2 to the data lines DL1 to DLm during a display period in which the display mode is executed, and sequentially output at least two sensing grayscale voltages Von to each of the data lines DL1 to DLm during a sensing period in which the sensing mode is executed. In an example, the data signal generation circuit 310 may include a shift register, a latch, a digital-analog converter, and a buffer.

For example, during the display period, the data signal generation circuit 310 may generate data signals Vdata, and supply the data signals Vdata to the respective data lines DL1 to DLm. For each horizontal period of the display period, the data signal generation circuit 310 may supply, to the data lines DL1 to DLm, data signals Vdata corresponding to pixels PXL of a selected horizontal line in the corresponding horizontal period. In an example, for each horizontal period of the display period, the data signal generation circuit 310 may output a data signal Vdata corresponding to a pixel PXL disposed in a j-th column of the corresponding horizontal line.

During the sensing period, the data signal generation circuit 310 may sequentially generate at least two sensing grayscale voltages Von including a first voltage Von1 (also referred to as a "first sensing grayscale voltage") and a second voltage Von2 (also referred to as a "second sensing grayscale voltage"), corresponding to the data control signal DCS (e.g., a sensing control signal generated by the timing controller 400), and sequentially, alternately, and/or repeatedly supply the at least two sensing grayscale voltages Von to each of the data lines DL1 to DLm. In an example, the data signal generation circuit 310 may output the first voltage Von1 to the data lines DL1 to DLm during a first period of the sensing period, and output the second voltage Von2 to the data lines DL1 to DLm during a second period of the sensing period.

In an embodiment, the first period of the sensing period may include sensing horizontal periods for supplying the first voltage Von1 to pixels PXL disposed along horizontal lines while sequentially scanning the pixels PXL. Similarly, the second period of the sensing period may include sensing horizontal periods for supplying the second voltage Von2 to pixels PXL disposed along horizontal lines while sequentially scanning the pixels PXL. In an embodiment, the second period may be subsequent to the first period.

During the sensing period, when the first voltage Von1 is supplied to the pixel PXL, a driving current corresponding to the first voltage Von1 may flow in the pixel PXL. During the sensing period, when the second voltage Von2 is supplied to the pixel PXL, a driving current corresponding to the second voltage Von2 may flow in the pixel PXL. For example, the driving current corresponding to the first voltage Von1 may flow in the pixel PXL during the first period of the sensing period, and the driving current corresponding to the second voltage Von2 may flow in the pixel PXL during the second period of the sensing period.

The sensing circuit 320 may supply the third power voltage VINT to pixels PXL through each of the readout lines RL1 to RLq during the display period and the sensing period. For example, the sensing circuit 320 may supply the third power voltage VINT to a pixel PXL disposed in a j-th column through the p-th readout line RLp.

The sensing circuit 320 may sense a driving current of pixels PXL through each of the readout lines RL1 to RLq during the sensing period. The sensing circuit 320 may generate digital sensing signals DSS corresponding to the driving current of the pixels PXL, and output the digital sensing signals DSS to the data driver 300. The digital sensing signals DSS may include information on an electrical characteristic of each of the pixels PXL (e.g., a threshold voltage of the first transistor T1).

For example, during the first period of the sensing period, the sensing circuit 320 may sense a driving current of a pixel PXL disposed in the j-th column (e.g., a driving current of a pixel PXL, which corresponds to the first voltage Von1) through the p-th readout line RLp, and output a first digital sensing signal DSS1 (also referred to as a "first sensing signal"), corresponding to the driving current. During the second period of the sensing period, the sensing circuit 320 may sense a driving current of a pixel PXL disposed in the j-th column (e.g., a driving current of a pixel PXL, which corresponds to the second voltage Von2) through the p-th readout line RLp, and output a second digital sensing signal DSS2 (also referred to as a "second sensing signal"), corresponding to the driving current. In an embodiment, the first digital sensing signal DSS1 may be a signal obtained by converting a first analog signal ASS1 generated by sensing the driving current of the pixel PXL, which corresponds to the first voltage Von1, into a digital signal during the first period, and the second digital sensing signal DSS2 may be a signal obtained by converting a second analog signal ASS2 generated by sensing the driving current of the pixel PXL, which corresponds to the second voltage Von2, into a digital signal during the second period. The first digital sensing signal DSS1 and the second digital sensing signal DSS2 may be input to the timing controller 400 to be used to compensate for an electrical characteristic of the pixel PXL.

The first voltage Von1 and the second voltage Von2 may be grayscale voltages corresponding to different grayscale values. For example, the first voltage Von1 may be a grayscale voltage corresponding to a first grayscale value, and the second voltage Von2 may be a grayscale voltage corresponding to a second grayscale value greater than the first grayscale value. In an example, the first voltage Von1 may be a voltage, by which the first transistor T1 of the pixel PXL is turned on to generate a driving current corresponding to the first grayscale value, and the second voltage Von2 may be a voltage, by which the first transistor T1 of the pixel PXL is turned on to generate a driving current corresponding to the second grayscale value.

In some embodiments, the first grayscale value and the second grayscale value may be grayscale values, which are included in different grayscale ranges, respectively. For example, the first grayscale value may be one of grayscale values included in a low grayscale range (hereinafter, referred to as a "first grayscale range") corresponding to a driving current smaller than a reference current (e.g., a predetermined reference current), and the second grayscale value may be one of grayscale values included in the other grayscale range (hereinafter, referred to as a "second grayscale range") corresponding to a driving current equal to or greater than the reference current.

In some embodiments, a driving current of each pixel PXL may be changed in different aspects or manner in the first grayscale range and the second grayscale range. For example, in the second grayscale range, the driving current flowing in each pixel PXL may be changed according to a gate-source voltage Vgs of the first transistor T1 and a threshold voltage Vth of the first transistor t1 as shown in the following Equation 1. In an example, the second grayscale range may be a grayscale range, in which grayscale values satisfy Equation 1 among all grayscale values corresponding to the driving range of the pixel PXL.

Equation 1

$$Id=\alpha(Vgs-Vth)^2$$

In Equation 1, Id is a driving current of the pixel PXL, a is a constant, Vgs is a gate-source voltage of the first transistor T1, and Vth is a threshold voltage of the first transistor T1.

The first grayscale range may be a grayscale range, in which low grayscale values do not satisfy Equation 1 among all the grayscale values corresponding to the driving range of the pixel PXL. For example, a reference grayscale value may be set based on a change in driving current of the pixel PXL, and the first grayscale range and the second grayscale range may be distinguished or determined from each other with respect to the reference grayscale value.

When an electrical characteristic of the pixel PXL is sensed by supplying only a sensing grayscale voltage Von (e.g., the second voltage Von2) included in the second grayscale range to the pixel PXL during the sensing period, and a change in electrical characteristic of the pixel PXL and/or a deviation between electrical characteristics of the pixel PXL are/is compensated based on the sensed electrical characteristic, it may be difficult to appropriately compensate for a change in electrical characteristic of the pixel PXL and/or a deviation between electrical characteristics of the pixel PXL in the first grayscale range.

Accordingly, in embodiments, during the sensing period, at least two sensing grayscale voltages Von including the first voltage Von1 corresponding to the first grayscale value included in the first grayscale range and the second voltage Von2 corresponding to the second grayscale value included in the second grayscale range can be supplied to each pixel PXL in different periods (e.g., different periods including the first period and the second period). In addition, driving currents of the pixel PXL, which correspond to the respective sensing grayscale voltages Von, (e.g., a driving current corresponding to the first voltage Von1 and a driving current corresponding to the second voltage Von2) can be individually sensed. Accordingly, electrical characteristics of the pixel PXL in the first grayscale range and the second grayscale range are more accurately sensed, so that the change in electrical characteristic of the pixel PXL and/or the deviation between electrical characteristics of the pixel PXL can be more precisely compensated according to each of the first and second grayscale values. Reference grayscales for sensing an electrical characteristic of the pixel PXL and sensing grayscale voltages Von corresponding thereto may be variously changed in some embodiments. In addition, a number of the reference grayscale values and the sensing grayscale voltages Von may also be changed in some embodiments.

In an embodiment, with respect to the first grayscale range, at least two sensing grayscale voltages Von may be supplied to the pixel PXL, and driving currents of the pixel PXL, which correspond to the respective sensing grayscale voltages Von, may be individually sensed. For example, during a third period in the sensing period in which the sensing mode is executed, the data driver 300 may supply a third voltage corresponding to a third grayscale value to the data lines DL1 to DLm, and generate a third sensing signal by sensing a driving current of each pixel PXL. The data driver 300 may supply the third sensing signal to the timing controller 400. The third grayscale value may be one of grayscale values included in the first grayscale range, and be a grayscale value different from the first grayscale value. The timing controller 400 may convert first image data DATA1 into second image data DATA2 such that an electrical characteristic of each pixel PXL is compensated, based on a first sensing signal, a second sensing signal, and a third sensing signal, which correspond to each pixel PXL (e.g., each block including at least two pixels PXL). Accordingly, an electrical characteristic of pixels PXL corresponding to the first grayscale range is more accurately sensed. Thus, the electrical characteristic of the pixels PXL can be appropriately compensated even in the first grayscale range.

The sensing circuit 320 may include an integrator 321 and a converter 322. In some embodiments, the sensing circuit 320 may further include at least one of a first switch SW1, a second switch SW2, a third switch SW3, a fourth switch SW4, and a hold capacitor Chold. In some embodiments, the sensing circuit 320 may further include at least another circuit element (e.g., at least another switch and/or at least another capacitor). In FIG. 3, a sensing channel connected to the pixel PXL disposed on the i-th row and the j-th column is illustrated, and a configuration of the sensing circuit 320 will be described based on the sensing channel.

Operations of the integrator 321, the converter 322, and/or the first switch SW1, the second switch SW2, the third switch SW3, and/or the fourth switch SW4 may be controlled by the timing controller 400. For example, the data control signal DCS included in the timing controller 400 may include control signals for controlling the integrator 321, the converter 322, and/or the first switch SW1, the second switch SW2, the third switch SW3, and/or the fourth switch SW4.

The first switch SW1 may be connected between a power line (e.g., power terminal) to which the third power voltage VINT is applied and the p-th readout line RLp. Also, the first switch SW1 may be connected between the integrator 321 and the p-th readout line RLp. The first switch SW1 may selectively connect the p-th readout line RLp to the power line to which the third power voltage VINT is applied or the integrator 321, corresponding to the display mode and the sensing mode.

In some embodiments, the first switch SW1 may include at least two switches. For example, the first switch SW1 may include a switch connected between the power line to which the third power voltage VINT is applied and the p-th readout line RLp, and a switch connected between the integrator 321 and the p-th readout line RLp.

A sensing capacitor Csen may be formed on and/or connected to the p-th readout line RLp. In some embodiments, the sensing capacitor Csen may be a component included in the sensing circuit 320.

During the display period, the first switch SW1 may connect the p-th readout line RLp to the power line to which the third power voltage VINT is applied. Accordingly, the third power voltage VINT may be applied to the p-th readout line RLp. During a corresponding horizontal period of the display period, the second and third transistors T2 and T3 may be respectively turned on by the i-th scan signal S[i] and the i-th sensing scan signal SEN[i]. When the second and third transistors T2 and T3 are turned on, a voltage corresponding to a voltage difference between the data signal Vdata and the third power voltage VINT may be charged in the storage capacitor Cst. Accordingly, during the display period, the pixel PXL may emit light with a luminance corresponding to the voltage difference between the data signal Vdata and the third power voltage VINT.

During the sensing period, the first switch SW1 may sequentially connect the p-th readout line RLp to the power line to which the third power voltage VINT is applied to the integrator 321. For example, during an initial period of a sensing horizontal period corresponding to a corresponding pixel PXL in the sensing period (e.g., a period in which the i-th scan signal S[i] is supplied to a pixel PXL of the first row), the first switch SW1 may connect the p-th readout line RLp to the power line to which the third power voltage VINT is applied. During the initial period, the i-th scan signal S[i] may be supplied to the i-th scan line SLi, and any one sensing grayscale voltage Von may be supplied to the j-th data line DLj. Accordingly, a voltage corresponding to a voltage difference between the sensing grayscale voltage Von and the third power voltage VINT may be charged in the storage capacitor Cst. In addition, the sensing capacitor Csen may be precharged with the third power voltage VINT. During a period subsequent to the initial period in the sensing horizontal period, the first switch SW1 may connect the p-th readout line RLp to the integrator 321. Accordingly, the integrator 321 may sense (e.g., integrate) a driving current flowing in the pixel PXL, corresponding to the sensing grayscale voltage Von, and output an analog sensing signal ASS corresponding the driving current.

In some embodiments, when the first voltage Von1 is supplied to the pixel PXL during a first period (e.g., a first cycle) of the sensing period, a driving current corresponding to the first voltage Von1 may flow in the pixel PXL. Accordingly, during the first period, the integrator 321 may output a first analog sensing signal ASS1 corresponding to the first voltage Von1. When the second voltage Von2 is supplied to the pixel PXL during a second period (e.g., second cycle) of the sensing period, a driving current corresponding to the second voltage Von2 may flow in the pixel PXL. Accordingly, during the second period, the integrator 321 may output a second analog sensing signal ASS2 corresponding to the second voltage Von2.

In an embodiment, when a k-th voltage is supplied to the pixel PXL during a k-th period (e.g., k-th cycle) of the sensing period, a driving current corresponding to the k-th voltage may flow in the pixel PXL, where k is a positive integer equal to or greater than 3. For example, when the third voltage is supplied to the pixel during a third period (e.g., third cycle) of the sensing period, a driving current corresponding to the third voltage may flow in the pixel PXL. Accordingly, during the k-th period, the integrator 321 may output a k-th analog sensing signal corresponding to the k-th voltage.

The integrator 321 may include an amplifier 321A, a variable capacitor 321B, and a reset switch SWr.

An input terminal (e.g., an inverting terminal (-)) of the amplifier 321A may be connected to the p-th readout line RLp, and a second input terminal (e.g., a non-inverting terminal (+)) of the amplifier 321A may be connected to the second switch SW2. The amplifier 321A may output an analog sensing signal ASS corresponding to a signal input to the first input terminal (e.g., a driving current of the pixel PXL or an input signal corresponding thereto). In an embodiment, the first input terminal and the second input terminal of the amplifier 321A may be respectively a first input terminal and a second input terminal of the integrator 321, and an output terminal of the amplifier 321A may be an output terminal of the integrator 321.

The variable capacitor 321B may be connected between the first input terminal of the amplifier 321A (e.g., the first input terminal of the integrator 321) and the output terminal of the amplifier 321A (e.g., the output terminal of the integrator 321). The variable capacitor 321B may include capacitors Camp connected in parallel to each other between the first input terminal and the output terminal of the amplifier 321A, and select switches SWs connected in parallel to each other between the first input terminal and the output terminal of the amplifier 321A to form pairs with the respective capacitors Camp. For example, the variable capacitor 321B may include a first capacitor Camp1 and a second capacitor Camp2, which are connected in parallel to each other between the first input terminal and the output terminal of the amplifier 321A, and a first select switch SWs1 and a second select switch SWs2, which respectively form pairs with the first capacitor Camp1 and the second capacitor Camp2.

The number of capacitors Camp and select switches SWs, which are included in the variable capacitor 321B, may be variously changed in some embodiments. For example, in some embodiments, the variable capacitor 321B may further include at least one pair of an additional capacitor Camp and an additional select switch SWs. In addition, although an embodiment in which the select switches SWs are connected to only one electrodes of the capacitors Camp is illustrated in FIG. 3, embodiments are not limited thereto. For example, a pair of select switches SWs may be provided at both sides of at least one capacitor Camp (e.g., between a first electrode of the at least one capacitor Camp and the first input terminal of the amplifier 321A and between a second electrode of the at least one capacitor Camp and the output terminal of the amplifier 321A).

Each select switch SWs may be connected between a capacitor Camp corresponding thereto and the output terminal of the amplifier 321A (e.g., between the capacitor Camp and the first input terminal of the amplifier 321A). The select switches SWs may be individually turned on/off by respective switch control signals (e.g., switch control signals supplied from the timing controller 400). The on/off state of the select switches SWs are adjusted, so that a capacitance of the variable capacitor 321B can be changed or adjusted.

The reset switch SWr may be connected between the first input terminal of the amplifier 321A (e.g., the first input terminal of the integrator 321) and the output terminal of the amplifier 321A (e.g., the output terminal of the integrator 321). For example, the reset switch SWr may be connected in parallel to the variable capacitor 321B. When the reset switch SWr is turned on, the first input terminal and the output terminal of the amplifier 321A may be connected to each other, and a voltage of the output terminal of the amplifier 321A may be initialized by the third power voltage VINT. When the reset switch SWr is turned off, a driving current output from the pixel PXL through the p-th readout line RLp (e.g., an input signal of the integrator 321, corresponding to the driving signal) may be integrated by the variable capacitor 321B, and the amplifier 321A may output an analog sensing signal ASS corresponding to the integrated signal.

During the sensing period, the integrator 321 may output an analog sensing signal ASS by sensing a driving current of the pixel PXL. For example, during the first period of the sensing period, the integrator 321 may output the first analog sensing signal ASS1 by sensing a driving current of the pixel PXL, which correspond to the first voltage Von1. During the second period of the sensing period, the integrator 321 may output the second analog sensing signal ASS2 by sensing a driving current of the pixel PXL, which correspond to the second voltage Von2.

The second switch SW2 may be connected between the power line to which the third power voltage VINT is applied and the second input terminal of the amplifier 321A. When the second switch SW2 is turned on, the third power voltage VINT may be applied to the second input terminal of the amplifier 321A.

The third switch SW3 may be connected between the output terminal of the amplifier 321A and the hold capacitor Chold. The hold capacitor Chold may be connected between a node at which the third switch SW3 and the fourth switch SW4 are connected to each other and a power line (e.g., power terminal) to which a reference voltage VREF is applied. When the third switch SW3 is turned on, a voltage of the output terminal of the amplifier 321A (e.g., an analog sensing signal ASS) may be stored or sampled in the hold capacitor Chold.

The fourth switch SW4 may be connected between the hold capacitor Chold and the converter 322. When the fourth switch SW4 is turned on, the analog sensing signal ASS stored or sampled in the hold capacitor Chold may be input to the converter 322.

The converter 322 may convert an analog sensing signal ASS into a digital sensing signal DSS. In an example, the converter 322 may convert the first analog sensing signal ASS1 output from the integrator 321 during the first period of the sensing period into the first digital sensing signal DSS1, and convert the second analog sensing signal ASS2 output from the integrator 321 during the second period of the sensing period into the second digital sensing signal DSS2. For example, the converter 322 may be an analog-to-digital converter (ADC) which converts an analog sensing signal ASS into a digital sensing signal DSS.

The digital sensing signal DSS output from the converter 322 may be input to the timing controller 400. The timing controller 400 may convert the first image data DATA1 into the second image data DATA2, based on digital sensing signals DSS corresponding to at least two grayscale values (e.g., digital sensing signals DSS including the first digital sensing signal DSS1 and the second digital sensing signal DSS2).

Figure 4:
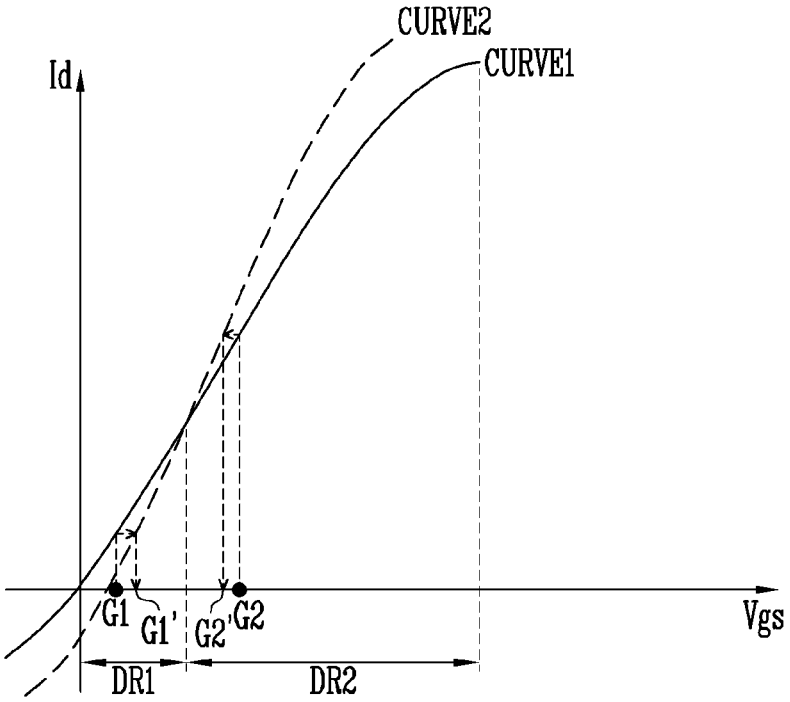
FIGS. 4 and 5 are diagrams illustrating a voltage-current characteristic of a first transistor included in the pixel in FIG. 2 and a change in the voltage-current characteristic.
Figure 5:
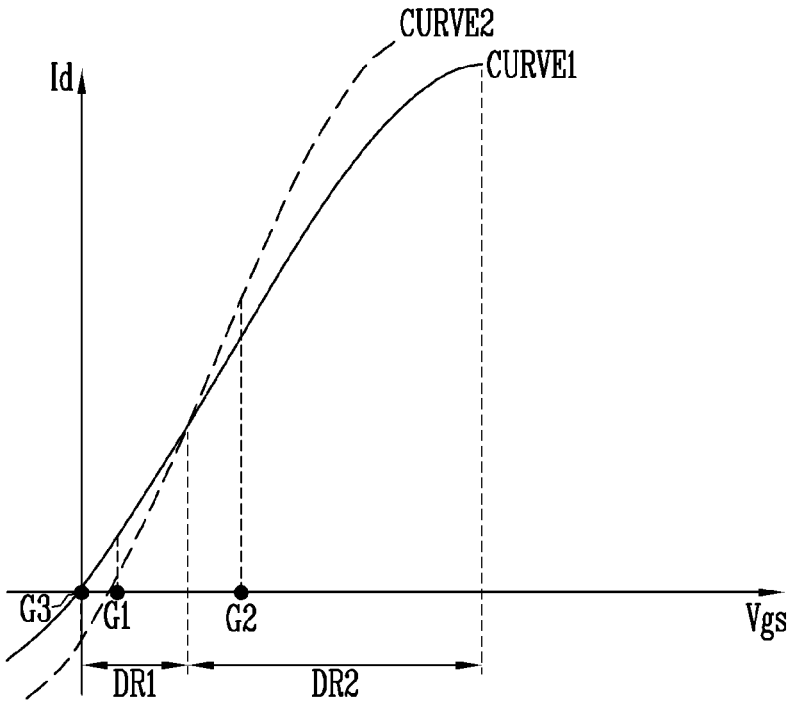

FIGS. 4 and 5 are diagrams illustrating a voltage-current characteristic of the first transistor T1 included in the pixel PXL shown in FIG. 2 and a change therein.

First, referring to FIGS. 1, 2, 3, and 4, the first transistor T1 may generate a driving current Id having a magnitude corresponding to the gate-source voltage Vgs. However, the amount of accumulated use(e.g., an age or stress time) of the first transistor T1 increases as time elapses. Thus, the first transistor T1 may be degraded. A voltage-current characteristic of the first transistor T1 may be changed as the first transistor T1 is degraded. For example, the first transistor T1 may represent a voltage-current characteristic such as a first curve CURVE1 at an initial state in which the display device 10 is used, and the second transistor T2 may represent a changed voltage-current characteristic such as a second curve CURVE2 as the amount of accumulated use of the first transistor T1 increases.

In an embodiment, the first transistor T1 may represent a voltage-current characteristic changed in different aspects or manner according to a range of the gate-source voltage Vgs. For example, with respect to a gate-source voltage Vgs in a first range DR1 (e.g., a gate-source voltage Vgs corresponding to grayscale values in a first grayscale range), the driving current Id may decrease as the first transistor T1 is degraded. With respect to a gate-source voltage Vgs in a second range DR2 (e.g., a gate-source voltage Vgs corresponding to grayscale values in a second grayscale range), the driving current Id may increase as the first transistor T1 is degraded.

Accordingly, in embodiments, a driving current Id of the pixel PXL, which corresponds to at least one grayscale value among grayscale values included in a first grayscale range (e.g., a low grayscale range) corresponding to the gate-source voltage Vgs in the first range DR1, and a driving current Id of the pixel PXL, which corresponds to at least one grayscale value among grayscale values included in a first grayscale range (e.g., a low grayscale range) corresponding to the gate-source voltage Vgs in the second range DR2, may be sensed, and the grayscale values in the first grayscale range and the second grayscale range may be changed (e.g., compensated) according to the sensed driving currents Id. For example, in embodiments, during the first period of the sensing period, a driving current Id of the pixel PXL may be sensed after a first grayscale value G1 in the first grayscale range, which corresponds to the gate-source voltage Vgs in the first range DR1, (e.g., a gate-source voltage Vgs corresponding to the first grayscale value G1) is supplied to the pixel PXL. During the second period of the sensing period, a driving current Id of the pixel PXL may be sensed after a second grayscale value G2 in the second grayscale range, which corresponds to the gate-source voltage Vgs in the second range DR2, (e.g., a gate-source voltage Vgs corresponding to the second grayscale value G2) is supplied to the pixel PXL. Accordingly, a voltage-current characteristic according to degradation of the first transistor T1 at a time corresponding to each sensing period (e.g., the second curve CURVE2) may be derived. For example, the timing controller 400 may generate a voltage-current characteristic according to degradation of the first transistor T1, based on the digital sensing signals DSS output from the sensing circuit 320.

The timing controller 400 may convert first image data DATA1 into second image data DATA2 such that a change in voltage-current characteristic and/or a deviation between voltage-current characteristics according to degradation of the first transistor T1 are/is compensated. For example, when the first transistor T1 represents a voltage-current characteristic such as the second curve CURVE2, the timing controller 400 may generate, on the second curve CURVE2, a gate-source voltage Vgs at a point at which a driving current Id equal to the driving current Id in the first curve CURVE1, which corresponds to the first grayscale value G1, flows and a first compensated grayscale value G1' corresponding thereto (e.g., a gate-source voltage Vgs corresponding to the first compensated grayscale value G1'), or a first compensation value according thereto. In a similar manner or the same manner, the timing controller 400 may generate a second compensated grayscale value G2' corresponding to the second grayscale value G2 (e.g., a gate-source voltage Vgs corresponding to the second compensated grayscale value G2') or a second compensation value according thereto.

The timing controller 400 may convert the first image data DATA1 into the second image data DATA2, based on respective compensated values (e.g., respective compensation values). For example, the timing controller 400 may calculate respective compensated grayscale values (e.g., respective compensation values) by using a first relational expression and/or interpolation, in which the first compensated grayscale value G1' is applied to grayscale values included in the first grayscale range among grayscale values included in the first image data DATA1, and convert the grayscale values included in the first image data DATA1, based on the calculated compensated grayscale values (e.g., compensation values). The timing controller 400 may generate respective compensated grayscale values (e.g., respective compensation values) by using a second relational expression and/or interpolation, in which the second compensated grayscale value G2' is applied to grayscale values included in the second grayscale range among the grayscale values included in the first image data DATA1, and convert the grayscale values included in the first image data DATA1, based on the calculate compensated grayscale values (e.g., compensation values).

In some embodiments, during the sensing period, the timing controller 400 may sequentially and/or alternately supply at least three sensing grayscale voltages Von corresponding to at least three grayscale values to the pixel PXL, and accordingly, at least three compensated grayscale values may be generated. For example, as shown in FIG. 5, the timing controller 400 may set at least two grayscale values as reference grayscale values with respect to the first range DR1, and generate respective compensation values with respect to the at least two grayscale values.

In an example, the timing controller 400 may control the data driver 300 to generate compensation values corresponding to the first grayscale value G1 and a third grayscale value G3 with respect to the first range DR1. The first grayscale value G1 and the third grayscale value G3 may be different grayscale values among grayscale values in a low grayscale range.

For example, during a third period of the sensing period, the timing controller 400 may control the data signal generation circuit 310 to supply a third voltage corresponding to the third grayscale value G3 (e.g., a sensing grayscale voltage Von corresponding to the third grayscale value G3) to the data lines DL1 to DLm (e.g., the j-th data line DLj). Accordingly, a driving current ID corresponding to the third voltage may be generated in the pixel PXL. During the third period of the sensing period, the sensing circuit 320 may output a third digital sensing signal by sensing the driving current of the pixel PXL, which corresponds to the third voltage. The timing controller 400 may convert the first image data DATA1 into the second image data DATA2, based on digital sensing signals DSS including the first digital sensing signal DSS1, the second digital sensing signal DSS2, and the third digital sensing signal. Accordingly, an electrical characteristic of the pixel PXL can be more accurately sensed even in a low grayscale range.

The sensing grayscale values and the number of the sensing grayscale values with respect to each grayscale range may be variously changed in some embodiments. For example, when it is difficult to precisely model an electrical characteristic of the pixel PXL with a relational expression using one variable in the first grayscale range (e.g., low grayscale range), an electrical characteristic of the pixel PXL and/or a change in the electrical characteristic of the pixel PXL may be modeled by setting a relational expressing using two or more variables. In addition, an electrical characteristic of the pixel PXL is sensed by setting, as sensing grayscale values in the first grayscale range, grayscale values of which number is equal to or greater than the number of variables used in the relational expression in the first grayscale range. Thus, the electrical characteristic of the pixel PXL can be more precisely compensated even in the first grayscale range.

In some embodiments, when voltage-current characteristics according to degradation of the first transistor T1 and/or aspects of changes in the voltage-current characteristics are different from each other in the first grayscale range and the second grayscale range, a degradation characteristic of a first transistor T1 (e.g., a pixel PXL including the first transistor T1) may be modeled by setting a relationship expression for each grayscale range, and degradation of the first transistor T1 (e.g., the pixel PXL) may be appropriately compensated by applying each relational expression for each grayscale range.

Figure 6:
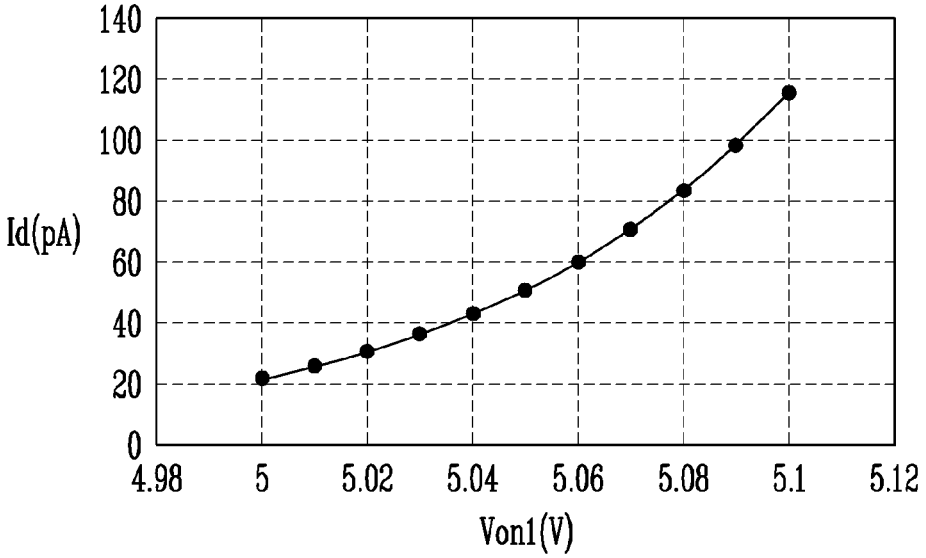
FIG. 6 is a diagram illustrating a driving current of the pixel according to a first voltage in a first grayscale range.
Figure 7:
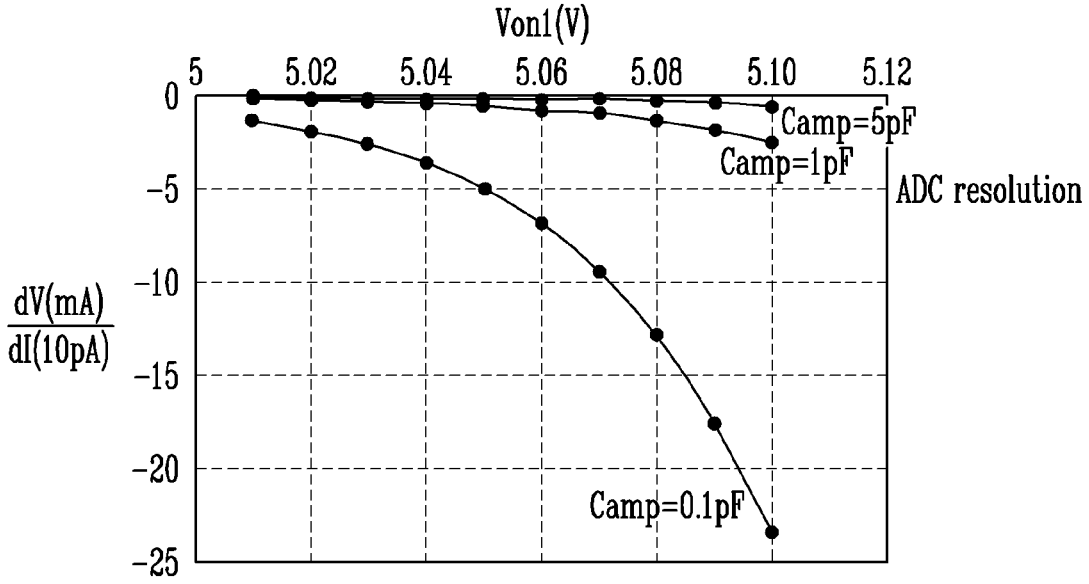
FIG. 7 is a diagram illustrating an output voltage of an integrator per unit current according to the first voltage in the first grayscale range and a variable capacity of the integrator.

FIG. 6 is a diagram illustrating a driving current Id of the pixel PXL according to a first voltage Von1 in a first grayscale range. For example, FIG. 6 illustrates a first voltage Von1 corresponding to a driving current Id in a low current range of about 20 pA to about 120 pA, and a driving current Id according to a value of the first voltage Von1. FIG. 7 is a diagram illustrating an output voltage dV/dI of the integrator 321 per unit current according to the first voltage Von1 in the first grayscale range and a variable capacity of the integrator 321. For example, FIG. 7 illustrates a first voltage Von1 in a low current range corresponding to the driving current Id shown in FIG. 6 and an output voltage of the integrator 321 per driving current of 10 pA according to the variable capacity of the integrator 321, which convert into mV. For example, the output voltage dV/dI may be a current-to-voltage conversion ratio of the integrator 321. For example, the integrator 321 may be in the form of a current-to-voltage converter. For example, the current-to-voltage converter may convert the driving current of the pixel into a sensing voltage at a current-to-voltage conversion ratio.

Figure 8:
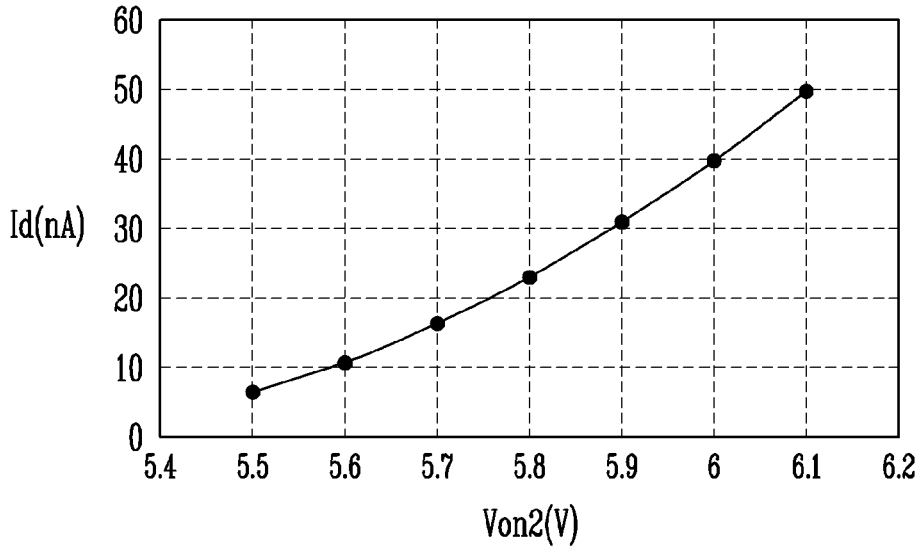
FIG. 8 is a diagram illustrating a driving current of the pixel according to a second voltage in a second grayscale range.
Figure 9:
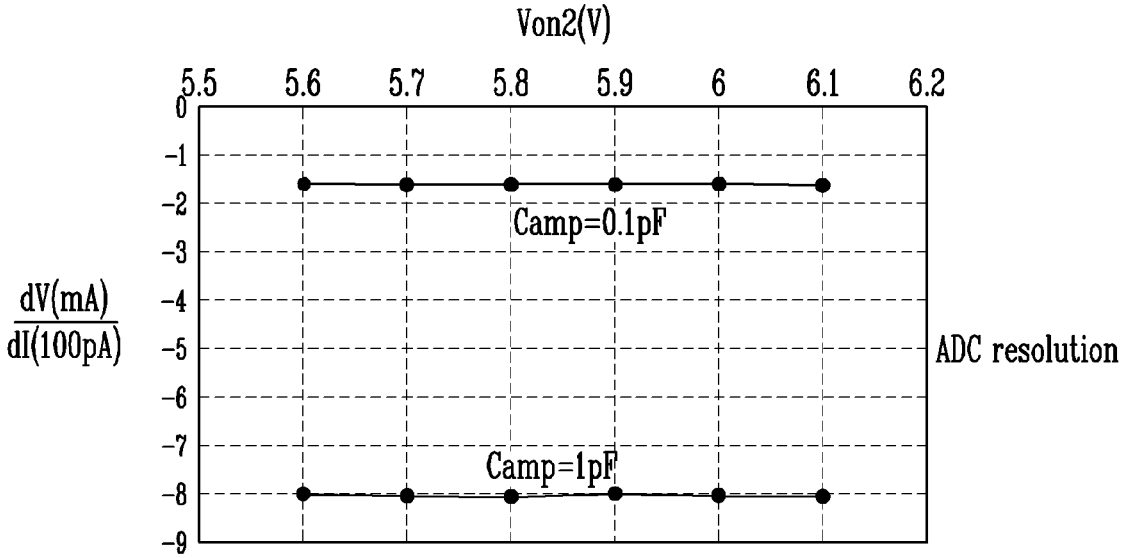
FIG. 9 is a diagram illustrating an output voltage of the integrator per unit current according to the second voltage in the second grayscale range and the variable capacity of the integrator.

FIG. 8 is a diagram illustrating a driving current Id of the pixel PXL according to a second voltage Von2 in a second grayscale range. For example, FIG. 8 illustrates a second voltage Von2 corresponding to a driving current Id in a low current range of about 10 nA to about 50 nA, and a driving current Id according to a value of the second voltage Von2. FIG. 9 is a diagram illustrating an output voltage dV/dI of the integrator 321 per unit current according to the second voltage Von2 in the second grayscale range and the variable capacity of the integrator 321. For example, FIG. 9 illustrates a second voltage Von2 in a low current range corresponding to the driving current Id shown in FIG. 8 and an output voltage of the integrator 321 per driving current of 100 pA according to the variable capacity of the integrator 321, which convert into mV.

First, referring to FIGS. 1, 2, 3, 4, 5, 6, and 7, the amount of sensed driving current Id may increase as the first voltage Von1 in the first grayscale range increases. The integrator 321 may output an analog sensing signal ASS (e.g., a first analog sensing signal ASS1) corresponding to the driving current Id.

An output characteristic of the integrator 321 may be changed according to a variable capacity of the integrator 321 (e.g., a capacitance of the variable capacitor 321B). In an example, when the driving current Id includes in a low current range of about 20 pA to about 120 pA, a change in voltage dV (mV)/dI (10 pA) per unit current of 10 pA is minute or very small when the variable capacity of the integrator 321 is equal to or greater than a reference value, and therefore may not be detected by of the converter 322 due to the limitation of a resolution (e.g., ADC resolution) of the converter 322.

For example, in the first grayscale range, when the variable capacity is 1 pF or more, a magnitude of the voltage dV (mV)/dI (10 pA) per unit current of 10 pA and/or a change in the magnitude are/is minute or very small, and therefore may not be detected by the converter 322 due to the limitations of the resolution of the converter 322.

Accordingly, it may be difficult to appropriately detect the driving current Id of the pixel PXL in the sensing circuit 320.

On the other hand, when the variable capacitor is less than the reference value, the change in voltage dV (mV)/dI (10 pA) per unit current of 10 pA in a first voltage Von1 (e.g., 5.05V or higher) corresponding to at least some grayscale values in the first grayscale range may be sufficiently equal to or greater than the resolution of the converter 322. Accordingly, the driving current Id of the pixel PXL in the sensing circuit 320 can be appropriately detected.

Referring to FIGS. 8 and 9, the amount of sensed driving current Id may increase as the second voltage Von2 in the second grayscale range increases. The integrator 321 may output an analog sensing signal ASS (e.g., a second analog sensing signal ASS2) corresponding to the driving current Id.

An output characteristic of the integrator 321 may be changed according to a variable capacity of the integrator 321. For example, the output voltage of the integrator 321 may be as shown in the following Equation 2.

Equation 2

$$\Delta Vout=(Id\times t)/Camp$$

In Equation 2, ΔVout is an output voltage of the integrator with respect to the third power voltage VINT (e.g., a difference between a voltage of the output terminal of the integrator 321 and the third power voltage VINT, Id is a driving current of the pixel PXL, t is a sensing time, and Camp is a variable capacity of the integrator 321 (e.g., a capacitance of the variable capacitor 321B, which is adjusted during each sensing period).

When the sensing time t is determined as a predetermined value or a predetermined range, an output of the integrator 321 may be minute or too small to a degree inappropriate to detect the driving current ID, if the variable capacity of the integrator 321 is not sufficiently small when the driving current ID is minute. In an example, when the variable capacity of the integrator 321 is less than the reference value (e.g., 0.1 pF) with respect to the driving current ID in a range of about 10 nA to about 50 nA, a magnitude of the voltage dV (mV)/dI (100 pA) per unit current of 100 pA and/or a change in the magnitude are/is minute, and therefore may not be detected due to the limitation of the resolution of the converter 322. Accordingly, it may be difficult to appropriately detect the driving current ID of the pixel PXL in the sensing circuit 320.

On the other hand, when the variable capacitor is equal to or greater than the reference value (e.g., 1 pF), the change in voltage dV (mV)/dI (100 pA) per unit current of 100 pA in a second voltage Von2 corresponding to at least some grayscale values in the second grayscale range may be sufficiently equal to or greater than the resolution of the converter 322. Accordingly, the driving current Id of the pixel PXL in the sensing circuit 320 can be appropriately detected.

Therefore, in embodiments, the variable capacity of the integrator 321 may be adjusted according to each sensing grayscale voltage Von. Also, in embodiments, the variable capacity of the integrator 321 may be adjusted according to the resolution of the converter 322.

For example, during the first period of the sensing period, the variable capacity of the integrator 321 may be adjusted to a first value according to the first voltage Von1. In an embodiment, the first value may be a value set to appropriately detect a driving current Id of the pixel PXL, which corresponds to the first voltage Von1 within a sensing time (e.g., a predetermined sensing time) included in the first period. Also, the first value may be a value set suitable for the resolution of the converter 322 such that the first analog sensing signal ASS1 output from the integrator 321, corresponding to the driving current Id of the pixel PXL, can be appropriately converted into the first digital sensing signal DSS1 in the converter 322. For example, the first value may be a value (e.g., 0.1 pF), which is set, determined, or optimized according to the first voltage Von1 and the resolution of the converter 322. For example, during the first period of the sensing period, the integrator 321 in the form of the current-to-voltage converter may convert the driving current Id of the pixel PXL intoto a first sensing current at a first current-to-voltage conversion ratio.

During the second period of the sensing period, the variable capacity of the integrator 321 may be adjusted to a second value different from the first value according to the second voltage Von2. For example, during the second period of the sensing period, the variable capacity of the integrator 321 may be adjusted to the second value greater than the first value. For example, during the second period of the sensing period, the integrator 321 in the form of the current-to-voltage converter may convert the driving current Id of the pixel PXL into a second sensing current at a second current-to-voltage conversion ratio, which is smaller than the first current-to-voltage conversion ratio.

In an embodiment, the second value may be a value set to appropriately detect a driving current Id of the pixel PXL, which corresponds to the second voltage Von2 within a sensing time (e.g., a predetermined sensing time) included in the second period. Also, the second value may be a value set suitable for the resolution of the converter 322 such that the second analog sensing signal ASS2 output from the integrator 321, corresponding to the driving current Id of the pixel PXL, can be appropriately converted into the second digital sensing signal DSS2 in the converter 322. For example, the second value may be a value (e.g., 1 pF), which is set, determined, or optimized according to the second voltage Von2 and the resolution of the converter 322.

As described above, in embodiments, a variable capacity-type integrator 321 may be provided in the sensing circuit 320, and a variable capacity of the integrator 321 may be adjusted to different values according to magnitudes of sensing grayscale voltages Von and/or a resolution of the converter 322. For example, the variable capacity of the integrator 321 may be adjusted and/or optimized to a sufficiently small value (e.g., the first value) to a degree to which the driving current Id of the pixel PXL can be appropriately detect within a set and/or limited sensing time t with respect to a sensing grayscale voltage Von (e.g., the first voltage Von1) in the first grayscale range. In addition, the variable capacity of the integrator 321 may be adjusted and/or optimized to the second value greater than the first value to a degree to which the driving current Id of the pixel PXL can be appropriately detect within a set and/or limited sensing time t with respect to a sensing grayscale voltage Von (e.g., the second voltage Von2) in the second grayscale range.

Accordingly, in the embodiments, the driving current ID of the pixel PXL is appropriately sensed with respect to grayscale values in the first and second grayscale ranges, so that an electrical characteristic of the pixel PXL can be more precisely and more efficiently sensed. Accordingly, the electrical characteristic of the pixel PXL can be more appropriately compensated.

Figure 10:
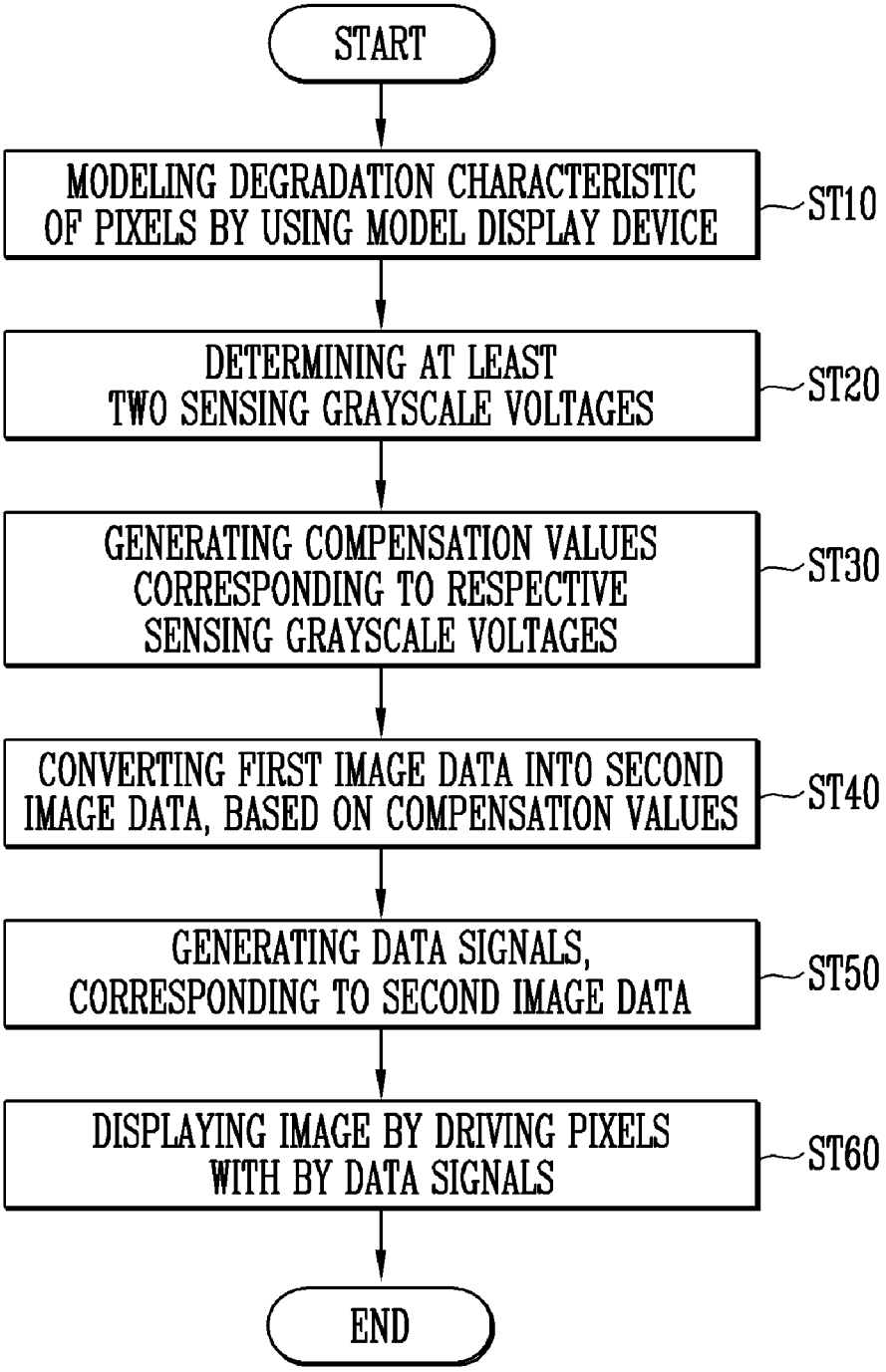
FIG. 10 is a diagram illustrating a method of compensating for an electrical characteristic of pixels and a method of driving the display device in accordance with an embodiment.

FIG. 10 is a diagram illustrating a method of compensating for an electrical characteristic of pixels PXL and a method of driving the display device 10 in accordance with an embodiment. For example, FIG. 10 illustrates a data compensation method (e.g., an external compensation method) of converting first image data DATA1 into second image data DATA2 to sense an electrical characteristic of pixels PXL during a sensing period and compensate for a change in the sensed electrical characteristic of the pixels PXL and/or a deviation between electrical characteristics and a driving method of the display device 10 in accordance with embodiments.

Referring to FIGS. 1 to 10, before an electrical characteristic of pixels PXL provided in the display device 10 is sensed, sensing grayscale voltages Von may be determined by modeling a degradation characteristic of the pixels PXL.

For example, the degradation characteristic of the pixels PXL may be modeled by using a sample display device as the same model as the display device 10. In embodiments, the entire grayscale range may be divided into at least two grayscale ranges, based on the modeled degradation characteristic of the pixels PXL, and a relational expression defining an electrical characteristic and/or a degradation characteristic of the pixels PXL according to each grayscale range may be set. In some embodiments, with respect to a predetermined reference current, a grayscale range corresponding to a driving current Id less than the reference current and a grayscale range corresponding to a driving current Id equal to or greater than the reference current may be respectively defined as a first grayscale range and a second grayscale range. In some embodiments, a grayscale in which an aspect of the electrical characteristic and/or the degradation characteristic of the pixels PXL is relatively considerably changed may be set as a reference grayscale, and a low grayscale range less than the reference grayscale and the other grayscale range equal to or greater than the reference grayscale may be respectively defined as the first grayscale range and the second grayscale range. In some embodiments, at least two reference grayscales may be set, and the entire grayscale range may be divided into at least three grayscale ranges, based on the at least two reference grayscales (ST10).

Subsequently, with respect to each grayscale range, at least one sensing grayscale value and at least one sensing grayscale voltage Von may be determined. For example, with respect to the first grayscale range, a first grayscale value G1 appropriate to sense the electrical characteristic of the pixels PXL and a first voltage Von1 corresponding to the first grayscale value G1 may be determined. In some embodiments, with respect to the first grayscale range, at least another grayscale value, e.g., a third grayscale value G3 and a third voltage corresponding to the third grayscale value G3 may be determined so as to more precisely sense the electrical characteristic of the pixels PXL. Similarly, with respect to the second grayscale range, a second grayscale value G2 appropriate to sense the electrical characteristic of the pixels PXL and a second voltage Von2 corresponding to the second grayscale value G2 may be determined. In some embodiments, with respect to the second grayscale range, at least another grayscale value, e.g., a fourth grayscale value G4 and a fourth voltage corresponding to the fourth grayscale value G4 may be determined so as to more precisely sense the electrical characteristic of the pixels PXL. In the above-described manner, at least two sensing grayscale voltages Von including the first voltage Von1 and the second voltage Von2 may be determined (ST20).

The steps ST10 and ST20 of determining the sensing grayscale voltages Von by modeling the degradation characteristic of the pixels PXL may be performed by using the sample display device before the display device 10 is released. The modeled degradation characteristic of the pixels PXL and sensing conditions (e.g., sensing grayscale values and/or sensing grayscale voltages Von) may be stored inside each of display devices 10 as the same model as each model display device (e.g., a memory provided in the timing controller).

Subsequently, compensation values corresponding to the respective sensing grayscale voltages Von may be generate by executing a sensing mode in each display device 10. For example, after the display device 10 is actually used, the sensing mode may be cyclically and/or conditionally executed, and compensation values corresponding to the respective sensing grayscale voltages Von may be generate during a sensing period in which the sensing mode is executed. In some embodiments, the sensing mode may be executed according to a predetermined cycle, a predetermined time, and/or a predetermined condition. For example, the sensing mode may be executed at a power-on time of the display device 10, a power-off time of the display device 10, and/or a vertical blank period between display periods. Alternatively, the sensing mode may be cyclically and/or conditionally executed according to the time of accumulated use of the display device 10, or be executed according to selection of a user. In some embodiments, the step of generating the compensation values corresponding to the respective sensing grayscale voltages Von may be sequentially and/or alternately performed during the sensing period, and be repeatedly performed (ST30).

Subsequently, during a display period in which a display mode is executed in each display device 10, data signals Vdata corresponding to second image data DATA2 generated based on the compensation values generated in the previous sensing period may be generated, and the pixels PXL may be driven by the data signals Vdata. Accordingly, a change in electrical characteristic of the pixels PXL and/or a deviation between electrical characteristics of the pixels PXL can be compensated.

For example, the first image data DATA1 may be converted into the second image data DATA2, based on the compensation values, and data signals Vdata may be generated corresponding to the second image data DATA2 (ST40 and ST50). In addition, the data signals Vdata may be respectively supplied to the pixels PXL through the data lines DL1 to DLm, so that the pixels PXL are driven by the data signals Vdata, thereby displaying an image on the display unit 100 (ST60).

Figure 11:
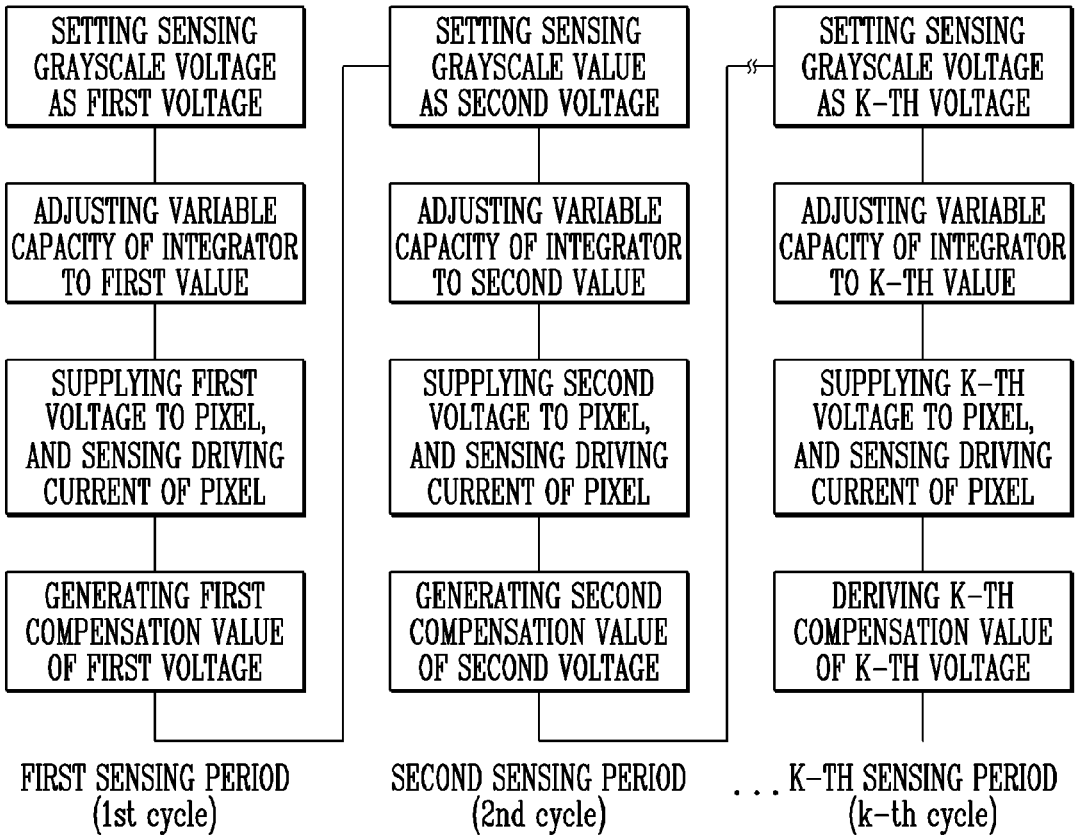
FIG. 11 is a diagram illustrating a method of driving the display device in accordance with another embodiment.

FIG. 11 is a diagram illustrating a method of driving the display device in accordance with an embodiment. For example, FIG. 11 illustrates a driving method of the display device 10, which correspond to the sensing mode, and illustrates a method of sensing an electrical characteristic of pixels PXL by executing the sensing mode in each display device 10, and generating compensation values according to the sensed electrical characteristic of the pixels PXL. In an embodiment, the driving method of the display device 10, which is disclosed in FIG. 11, may correspond to the step ST30 of generating the compensation values corresponding to the respective sensing grayscale voltages Von shown in FIG. 10.

Referring to FIGS. 1 to 11, during a first period (e.g., a period corresponding to a first cycle of the sensing period) (also referred to as a "first sensing period"), a sensing grayscale voltage Von may be set as a first voltage Von1, and a variable capacity of the integrator 321 provided in the sensing circuit 320 (e.g., a capacitance of the variable capacitor 321B) may be adjusted to a first value. Subsequently, the first voltage Von1 may be supplied to pixels PXL through each of the data lines DL1 to DLm, and a driving current Id of the pixels PXL may be sensed. Subsequently, a first compensation value of the first voltage Von1 may be generated based on a first digital sensing signal DSS1 generated according to the driving current Id of the pixels PXL.

During a second period (e.g., a period corresponding to a second cycle of the sensing period) (also referred to as a "second sensing period") subsequent to the first period, a sensing grayscale voltage Von may be set as a second voltage Von2, and the variable capacity of the integrator 321 may be adjusted to a second value. Subsequently, the second voltage Von2 may be supplied to pixels PXL through each of the data lines DL1 to DLm, and a driving current Id of the pixels PXL may be sensed. Subsequently, a second compensation value of the second voltage Von2 may be generated based on a second digital sensing signal DSS2 generated according to the driving current Id of the pixels PXL.

When sensing grayscale voltages Von are set as only the first voltage Von1 and the second voltage Von2, the step of generating the first compensation value and the second compensation value of the first voltage Von1 and the second voltage Von2 may be sequentially, alternately, and/or repeatedly performed during the sensing period in which the sensing mode is executed.

The first compensation value and the second compensation value may be used to convert first image data DATA1 into second image data DATA2 during the display period subsequent to the sensing period. For example, the timing controller 400 may convert the first image data DATA1 into the second image data DATA2, based on the first compensation value and the second compensation value.

When at least one sensing grayscale voltage Von is further set in addition to the first voltage Von1 and the second voltage Von2, a compensation value of the at least one sensing grayscale voltage Von may be generated in the substantially same manner. For example, during a k-th period (e.g., a third period or a period corresponding to a k-th cycle of the sensing period), which is referred to as a "k-th sensing period", subsequent to the first period and the second period, the variable capacity of the integrator 321 may be adjusted to a k-th value (e.g., a third value), where k is a positive integer equal to or greater than 3. Subsequently, the k-th voltage may be supplied to the pixels PXL through each of the data lines DL1 to DLm, and a driving current Id of the pixels PXL may be sensed. Subsequently, a k-th compensation value (e.g., a third compensation value) of the k-th voltage may be generated based on a k-th digital sensing signal (e.g., a third digital sensing signal) generated according to the driving current Id of the pixels PXL.

The k-th compensation value may be used together with the first compensation value and the second compensation value in converting the first image data DATA1 into the second image data DATA2 during the display period subsequent to the sensing period. For example, the timing controller 400 may convert the first image data DATA1 into the second image data DATA2, based on the first compensation value, the second compensation value, and the k-th compensation value.

In accordance with various embodiments as described above, during the sensing period, sensing grayscale voltages Von corresponding to at least two sensing grayscale values including a first grayscale value G1 and a second grayscale value G2 may be supplied to pixels PXL, and a driving current Id flowing in the pixels PXL, corresponding to the sensing grayscale voltages Von, may be individually and/or independently sensed. Accordingly, an electrical characteristic of the pixels PXL can be more precisely and/or more accurately sensed and compensated.

In embodiments, the sensing circuit 320 which senses an electrical characteristic of the pixels PXL may include a variable capacity-type integrator 321 including a variable capacity 321B, and adjust a variable capacity of the integrator 321 (e.g., a capacitance of the variable capacitor 321B provided in the integrator 321) according to each of sensing grayscale voltages Von. For example, the variable capacity of the integrator 321 is set to a relative small value with respect to a sensing grayscale voltage (e.g., the first voltage Von1) in a low grayscale range, so that the driving current Id of the pixels PXL with respect to the sensing grayscale voltage Von can be efficiently and/or stably sensed while reducing or minimizing a sensing time. The variable capacity of the integrator 321 is set to a relatively large value with respect to a sensing grayscale voltage (e.g., the second voltage Von2) in the other range, so that the driving current Id of the pixels PXL with respect to the sensing grayscale voltage Von can be stably sensed.

The sensing circuit 320 may convert analog sensing signals ASS corresponding to the sensed driving current Id of the pixels PXL into respective digital sensing signals DSS, and supply the digital sensing signals DSS to the timing controller 400. The timing controller 400 may convert the first image data DATA1 into the second image data DATA2 such that a change in electrical characteristic of the pixels PXL and/or a deviation between electrical characteristics of the pixels PXL can be compensated based on the digital sensing signals DSS, and supply the second image data DATA2 to the data driver 300.

The data driver 300 may generate data signals Vdata corresponding to the second image data DATA2, and supply the data signals Vdata to the respective pixels PXL. Accordingly, the change in electrical characteristic of the pixels PXL and/or the deviation between electrical characteristics of the pixels PXL can be compensated, and an image having uniform image quality can be displayed.

In the display device and the method of driving the same in accordance with the embodiments, an electrically characteristic of pixels can be more accurately and more efficiently sensed. Accordingly, a change in electrical characteristic of the pixels and/or a deviation between electrical characteristics of the pixels can be appropriately compensated, and the image quality and reliability of the display device can be improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

a display unit including a scan line, a data line, and a pixel connected to the scan line and the data line;

a scan driver to supply a scan signal to the scan line;

a data driver to supply a data signal to the data line in a display mode, supply a first voltage and a second voltage to the data line respectively during a first period and a second period in a sensing mode, and output a first sensing signal and a second sensing signal by sensing a driving current of the pixel during the first period and the second period; and a timing controller to convert first image data into second image data, based on the first sensing signal and the second sensing signal, wherein the data driver includes an integrator outputting a first analog sensing signal and a second analog sensing signal by sensing a driving current of the pixel during the first period and the second period, the integrator including a variable capacitor, and wherein, during the first period and the second period, a capacitance of the variable capacitor is adjusted to different values according to the first voltage and the second voltage.

2. The display device of claim 1, wherein:

the first voltage is a sensing grayscale voltage corresponding to a first grayscale value, and the second voltage is a sensing grayscale voltage corresponding to a second grayscale value greater than the first grayscale value.

3. The display device of claim 2, wherein the capacitance of the variable capacitor is adjusted to a first value during the first period, and wherein the capacitance of the variable capacitor is adjusted to a second value greater than the first value during the second period.

4. The display device of claim 2, wherein:

the first grayscale value is a grayscale value in a first grayscale range, which corresponds a driving current smaller than a reference current, and the second grayscale value is a grayscale value in a second grayscale range, which corresponds to a driving current equal to or greater than the reference current.

5. The display device of claim 4, wherein, in the sensing mode, the data driver is to supply a third voltage to the data line during a third period, and outputs a third sensing signal by sensing a driving current of the pixel during the third period, and wherein the timing controller is to convert the first image data into the second image data, based on the first sensing signal, the second sensing signal, and the third sensing signal.

6. The display device of claim 5, wherein the third voltage is a sensing grayscale voltage which is included in the first grayscale range and is different from the first grayscale value.

7. The display device of claim 1, wherein the data driver further includes a converter connected to an output terminal of the integrator, the converter to convert the first analog sensing signal and the second analog sensing signal respectively into the first sensing signal and the second sensing signal.

8. The display device of claim 7, wherein, during the first period and the second period, the capacitance of the variable capacitor is adjusted according to the first voltage, the second voltage, and a resolution of the converter.

9. The display device of claim 1, wherein, in the display mode, the timing controller is to output the second image data to the data driver, and the data driver is to generate the data signal, based on the second image data.

10. A method of driving a display device, the method comprising:

setting a sensing grayscale voltage as a first voltage;

adjusting a variable capacity of an integrator included in a sensing circuit to a first value;

supplying the first voltage to a pixel, and sensing a driving current of the pixel;

generating a first compensation value of the first voltage;

setting the sensing grayscale voltage as a second voltage;

adjusting the variable capacity of the integrator to a second value;

supplying the second voltage to the pixel, and sensing a driving current of the pixel;

generating a second compensation value of the second voltage;

converting first image data into second image data, based on the first compensation value and the second compensation value;

generating a data signal, based on the second image data; and driving the pixel with the data signal.

11. The method of claim 10, wherein:

the first voltage is a voltage corresponding to a first grayscale value, and the second voltage is a voltage corresponding to a second grayscale value greater than the first grayscale value.

12. The method of claim 11, wherein the variable capacity of the integrator, which is adjusted to the second value, is greater than the variable capacity of the integrator, which is adjusted to the first value.

13. The method of claim 11, wherein:

the first grayscale value is a grayscale value in a first grayscale range, which corresponds to a driving current smaller than a reference current, and the second grayscale value is a grayscale value in a second grayscale range, which corresponds to a driving current equal to or greater than the reference current.

14. The method of claim 13, further comprising:

setting the sensing grayscale voltage as a third voltage;

adjusting the variable capacity of the integrator to a third value;

supplying the third voltage to the pixel, and sensing a driving current of the pixel; and generating a third compensation value of the third voltage, wherein the first image data is converted into the second image data, based on the first compensation value, the second compensation value, and the third compensation value.

15. The method of claim 14, wherein the third voltage is a voltage corresponding to a driving current smaller than the reference current, and is different from the first voltage.

16. A display device comprising:

a display unit including a scan line, a data line, a sensing line, and a pixel connected to the scan line, the data line, and the sensing line;

a scan driver to supply a scan signal to the scan line;

a data driver to supply a data signal to the data line in a display mode, supply a first voltage and a second voltage to the data line respectively during a first period and a second period in a sensing mode, and output a first sensing signal and a second sensing signal to the sensing line by sensing a driving current of the pixel during the first period and the second period; and a timing controller to convert first image data into second image data, based on the first sensing signal and the second sensing signal, wherein the data driver includes a current-to-voltage converter to convert the driving current of the pixel into a sensing voltage at different current-to-voltage conversion ratios according to the first voltage and the second voltage.

17. The display device of claim 16, wherein:

the first voltage is a sensing grayscale voltage corresponding to a first grayscale value, and the second voltage is a sensing grayscale voltage corresponding to a second grayscale value greater than the first grayscale value.

18. The display device of claim 17, wherein:

the current-to-voltage converter is to convert the driving current of the pixel to a first sensing current at a first current-to-voltage conversion ratio during the first period, and to convert the driving current of the pixel to a second sensing current at a second current-to-voltage conversion ratio during the second period, the first current-to-voltage conversion ratio being greater than the second current-to-voltage conversion ratio.

19. The display device of claim 17, wherein:

the first grayscale value is a grayscale value in a first grayscale range, which corresponds a driving current smaller than a reference current, and the second grayscale value is a grayscale value in a second grayscale range, which corresponds to a driving current equal to or greater than the reference current.

20. The display device of claim 16, wherein the the current-to-voltage converter include a variable capacitor, and wherein during the first period and the second period, a capacitance of the variable capacitor is adjusted to different values according to the first voltage and the second voltage.

* * * * *